US007651408B2

(12) United States Patent
Hagood et al.

(10) Patent No.: US 7,651,408 B2
(45) **Date of Patent: *Jan. 26, 2010**

(54) METHOD AND APPARATUS FOR ELASTIC TAILORING OF GOLF CLUB IMPACT

(75) Inventors: Nesbitt W. Hagood, Wellesley, MA (US); Jason Horodezky, Vista Santa Rosa, CA (US)

(73) Assignee: Head Technology GmbH, Ltd., Kennelbach (AT)

( * ) Notice: Subject to any disclaimer, the term of this patent is extended or adjusted under 35 U.S.C. 154(b) by 0 days.

This patent is subject to a terminal disclaimer.

(21) Appl. No.: 11/820,009

(22) Filed: Jun. 15, 2007

(65) Prior Publication Data

US 2008/0032813 A1 Feb. 7, 2008

Related U.S. Application Data

(62) Division of application No. 11/314,521, filed on Dec. 20, 2005, now Pat. No. 7,281,990.

(60) Provisional application No. 60/494,739, filed on Aug. 14, 2003.

(51) Int. Cl.
*A63B 53/04* (2006.01)

(52) U.S. Cl. ..... 473/329; 473/332; 473/342; 473/350

(58) Field of Classification Search ..... 473/324–350
See application file for complete search history.

(56) References Cited

U.S. PATENT DOCUMENTS 4,498,672 A 2/1985 Bulla
4,681,322 A * 7/1987 Straza et al. ..... 473/329
5,083,778 A * 1/1992 Douglass ..... 473/329
5,193,806 A 3/1993 Burkly
5,299,807 A 4/1994 Hutin
5,316,298 A 5/1994 Hutin
5,398,929 A * 3/1995 Kitaichi ..... 473/329
5,403,007 A * 4/1995 Chen ..... 473/342
5,505,453 A 4/1996 Mack
5,674,132 A 10/1997 Fisher
5,697,855 A 12/1997 Aizawar
5,766,094 A * 6/1998 Mahaffey et al. ..... 473/342
5,807,190 A 9/1998 Krumme et al.
5,967,903 A * 10/1999 Cheng ..... 473/342
6,001,030 A * 12/1999 Delaney ..... 473/329
6,193,615 B1 * 2/2001 Hirota ..... 473/329
6,277,033 B1 8/2001 Krumme et al.
6,302,807 B1 10/2001 Rohrer
6,328,661 B1 12/2001 Helmstetter et al.
6,332,849 B1 12/2001 Beasley et al.

(Continued)

*Primary Examiner*—Sebastiano Passaniti
(74) *Attorney, Agent, or Firm*—Leonard Tachner

(57) ABSTRACT

A method and apparatus for beneficially controlling the impact between a club head and a golf ball are described. A golf club head (such as on a driver, iron, or putter) has a body and a face mechanically supported thereon, wherein the face and body are elastically tailored to create beneficial face motion and deformation at impact. The tailored clubhead compliance is shown to influence impact properties and resulting ball parameters such as speed, direction and spin rates resulting from the impact event between the face of the club and the golf ball. Several embodiments are presented for controlling ball spin through design of the elastic and dynamic response of the face and body under impact loading.

5 Claims, 20 Drawing Sheets

U.S. PATENT DOCUMENTS 6,354,956 B1 * 3/2002 Doong ..... 473/219
6,354,961 B1 3/2002 Allen
6,364,789 B1 4/2002 Kosmatka
6,368,231 B1 * 4/2002 Chen ..... 473/329
6,431,997 B1 * 8/2002 Rohrer ..... 473/324
6,478,690 B2 11/2002 Helmstetter et al.
6,478,693 B2 11/2002 Matsunaga et al.
6,488,594 B1 12/2002 Card et al.
6,592,468 B2 7/2003 Vincent et al.
6,595,057 B2 7/2003 Bissonnette et al.
6,602,150 B1 8/2003 Kosmatka
6,605,007 B1 8/2003 Bissonnette et al.
7,281,990 B2 * 10/2007 Hagood et al. ..... 473/329
7,367,898 B2 * 5/2008 Hawkins et al. ..... 473/329
7,461,726 B2 * 12/2008 Hawkins et al. ..... 188/371

* cited by examiner

CLUB HOUSING

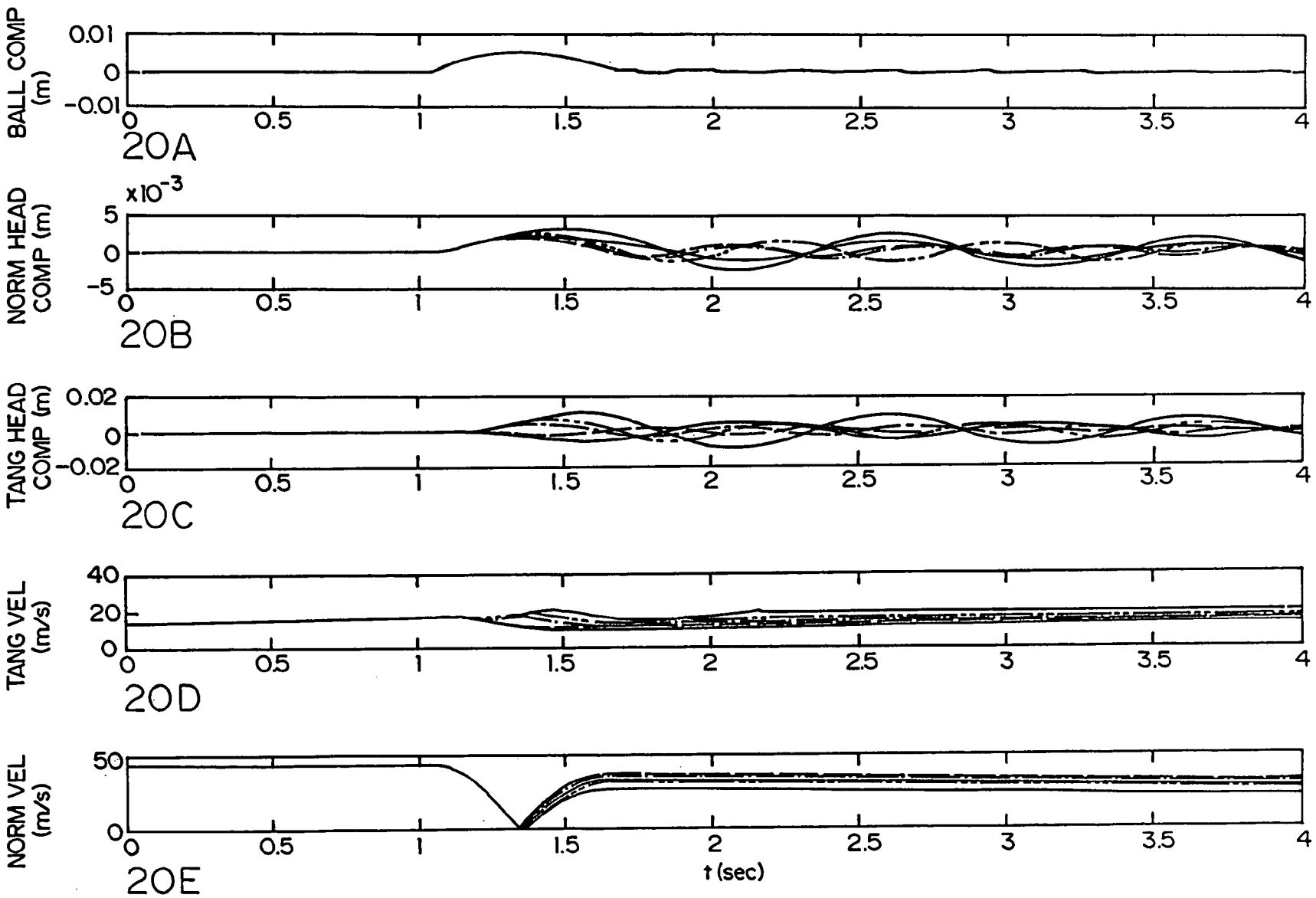
BALL COMP (m)
0.01
0
-0.01
0
0.5
1
1.5
2
2.5
3
3.5
4
20A
NORM HEAD COMP (m)
x10^-3
5
0
-5
20B
TANG HEAD COMP (m)
0.02
0
-0.02
20C
TANG VEL (m/s)
40
20
0
20D
NORM VEL (m/s)
50
0
t (sec)
20E

METHOD AND APPARATUS FOR ELASTIC TAILORING OF GOLF CLUB IMPACT

CROSS-RELATED APPLICATIONS

This application claims priority from Utility patent application Ser. No. 11/314,521 filed Dec. 20, 2005 which takes priority from Provisional Patent Application Ser. No. 60/638,834 filed Dec. 22, 2004.

BACKGROUND OF THE INVENTION

1. Field of the Invention

The present invention pertains to the field of advanced sporting equipment design and in particular to a golf club head system for a putter, driver, or iron designed for control of spin resulting from impact between the club head and a golf ball through elastically tailoring normal and tangential impact compliance.

2. Background Art

The present invention pertains to achieving an increase in the accuracy and distance of a golf club (e.g., a driver, putter or iron) through the application of structural design techniques and elastic tailoring of the club and in particular to enhancing or diminishing ball spins. There have been many improvements over the years which have had measurable impact on the accuracy and distance which a golfer can achieve. Typical passive performance improvements such as head shape and volume, weight distribution and resulting components of the inertia tensor, face thickness and thickness profile, face curvatures and CG locations, all pertain to the selection of optimum constant physical and material parameters for the golf club.

The impact between the ball and the head can be modeled as an impact between two elastic/deformable bodies each having freedom to translate and rotate in space i.e., full 6 degrees of freedom (DOF) bodies, each having the ability to deform at impact, and each having fully populated mass and inertia tensors. The typical initial condition for this event is a stationary ball and high velocity head impacting the ball at a perhaps eccentric point substantially on or substantially off the face of the club head. The impact results in high forces both normal and tangential to the contact surfaces between the club head and the ball. These forces integrate over time to determine the speed and direction, forming velocity vector and spin vectors of the ball after it leaves the face, hereafter called the impact resultants. These interface forces are determined by many properties including elasticity of the two bodies, material properties and dissipation, surface friction coefficients, body masses and inertia tensors.

The present invention pertains to the design of the elastic structural parameters of the head and in particular the attachment between the head body and the face or face insert such that the impact resultants benefit from the elastic/dynamic response of the clubhead under the impact forces. For example the structural design can be such that the face deflections and dynamic response are selected to maximize or minimize ball spin resulting from the impact. There has been much work in the area of elastic tailoring of a golf club head to influence the impact of the head and the ball and the resulting ball flight.

U.S. Pat. No. 4,498,672 to Bulla issued Feb. 12, 1985 discloses a clubhead designed so that the elastic response of the club in the normal direction is tuned such that it's flexure frequency matches a distortion frequency of the ball. The goal is to increase flight distance by increasing the Coefficient of Restitution (COR).

U.S. Pat. No. 5,299,807 to Hutin issued Apr. 5, 1994 discloses a clubhead designed with a thin visco-elastic sheet sandwiched between a face and a club head for improving impact performance and feel. There's no mention of spin, but the patent describes an elastically supported face.

U.S. Pat. No. 5,316,298 to Hutin issued May 31, 1994 discloses a club head designed with a constrained layer visco-elastic damping treatment mounted on the face and or the body for noise tailoring. There's no mention of spin control or control of impact resultants, but the patent discloses an elastically supported face.

U.S. Pat. No. 5,505,453 to Mack issued Apr. 9, 1996, perhaps the closest to the present invention, discloses several (2) designs for an elastically supported impact plate whose support can be tuned to maximize normal response and exiting ball velocity for a given player. It essentially uses advanced analytical models (1-d) normal impact only to determine the optimal support stiffness in the normal direction to maximize ball velocity after impact. The patent shows two designs each applied to drivers, irons and putters. There's no mention of spin, but the patent discloses an elastically supported face.

U.S. Pat. No. 5,674,132 to Fisher issued Oct. 7, 1997 discloses a club head designed with an elastically tailored face insert designed to have an desired rebound factor and/or feel/hardness. There's no mention of spin, but the patent discloses an elastically tailored face.

U.S. Pat. No. 5,697,855 to Aizawar issued Dec. 16, 1997 discloses a clubhead (iron and driver) designed with an elastically supported face insert designed to have a desired damping factor. There's no mention of spin, but the patent discloses an elastically supported face insert.

U.S. Pat. No. 5,807,190 to Krumme et al. issued Sep. 15, 1998 and U.S. Pat. No. 6,277,033 to Krumme et al. issued Aug. 21, 2001 disclose a clubhead (iron and driver—190, and putter—033) designed with an elastically tailored face comprising a number of pixels each selected for its elastic properties and selectively arranged to give a desired face effect (sweet spot etc). There's no mention of spin, but the patent discloses an elastically tailored face design.

U.S. Pat. No. 6,001,030 to Delaney et al. issued Dec. 14, 1999 discloses a club head, (putter only) designed with a face insert constructed "with controlled compression", i.e., a rigid face impact plate elastically supported where the support is designed to provide a certain normal motion behavior depending on impact intensity and/or impact location. There is no mention of spin, but the patent discloses an elastically tailored face design.

U.S. Pat. No. 6,302,807 to Rohrer issued Oct. 16, 2001 discloses a golf club head (preferably putter) designed with variable energy absorption. It discloses designs for viscoelastic supported faces constructed to maximize dissipation in ideal hits and lower dissipation in off center miss-hits. There's no mention of spin, but the patent discloses an elastically tailored face design.

U.S. Pat. No. 6,328,661 to Helmstetter et al. issued Dec. 11, 2001 and U.S. Pat. No. 6,478,690 to Helmstetter et al. issued Nov. 12, 2002, "Multiple Material Golf Club Head with a Polymer Insert Base" disclose a golf club head (preferably putter) designed with a polymer face insert of carefully defined hardness and rebound i.e., an elastically tailored insert to effect impact COR and feel.

U.S. Pat. No. 6,332,849 to Beasley et al. issued Dec. 25, 2001, "Golf Club Driver with Gel Support of Face Wall" discloses a golf club head (preferably driver) designed with a viscoelastic member supporting the face and connected between the center of the face and the back of the hollow body of the clubhead.

U.S. Pat. No. 6,354,961 to Allen issued Mar. 12, 2002, "Golf Club Face Flexure Control System" discloses a golf club head (preferably driver) designed with a pneumatic piston/cylinder supporting the face and connected between the center of the face and the back of the hollow body of the clubhead. The piston is designed to make contact and change effective stiffness in a predetermined impact velocity range.

U.S. Pat. No. 6,364,789 to Kosmatka issued Apr. 2, 2002, "Golf Club Head" discloses a golf club head designed with an annular deflection enhancement member disposed between the club head body and a stiff face. The stiffness of the annular member is preferably lower then the face to enhance deflection of the face at impact and increase COR.

U.S. Pat. No. 6,478,693 to Matsunaga et al. issued Nov. 12, 2002, "Golf Club Head" discloses a golf club head (preferably driver or iron) designed with a variable thickness face with step changes in multiple tiered thickness regions. The centroids of the regions are designed and located to maximize the region of uniformity of strike response—i.e., increase the sweet spot under normal impact.

U.S. Pat. No. 6,488,594 to Card et al. issued Dec. 3, 2002, "Putter with a consistent Putting Face" discloses a putter designed with a face insert designed to maximize dissipation in ideal hits and lower dissipation in off center miss-hits. There's no mention of spin, but the patent discloses an elastically tailored face design.

U.S. Pat. No. 6,592,468 to Vincent et al. issued Jul. 15, 2003, "Golf Club Head" discloses a golf club head designed with a viso-elastically supported insert for increasing the damping in vibrations in the club caused by impact.

U.S. Pat. Nos. 6,595,057 and 6,605,007 to Bissonnette et al. issued Jul. 22, 2003 and Aug. 12 2003, respectively, "Golf Club Head with High Coefficient of Restitution" discloses a golf club with a face whose thickness is tailored to maximize COR. The face has a higher stiffness central zone and a lower stiffness surrounding zone.

U.S. Pat. No. 6,602,150 to Kosmatka issued Aug. 5, 2003, "Golf Club Striking Plate with Vibration Attenuation" discloses a golf club with a variable thickness face (thicker central portion) on which is disposed a viscoelastic material for face vibration attenuation.

All of the aforementioned patents deal with clubhead designs such that the elastic response of the head and face during impact impart a benefit to feel and or COR of the clubhead. None of the aforementioned patents has addressed the design of the elastic/dynamic response of the clubhead so as to effect beneficial control of the ball spin. U.S. Pat. No. 5,193,806 to Burkly issued Mar. 16,1993, discloses a clubhead designed with a circular shape contact surface to effect spin control, but does not teach the use of clubhead elastic response to achieve this. The face is assumed to be rigid. Numerous patents have attempted to address spin control through surface treatments of the contacting bodies, but none directly address control of spin by elastic/structural design of the clubhead.

SUMMARY OF THE INVENTION

The present invention pertains to a system for the control of the impact event between the ball and the club face using elastic tailoring of the face, body and intermediate support of the face to influence the progression of the impact event between the ball and the face. In particular, it pertains to the design of a face mounting system interspersed between the clubhead body and the face and specially designed to beneficially influence the ball spin through face motion and deformation resulting from impact. The control of ball spin is achieved through specific design of the elastic and dynamic response of the system under impact loading conditions. The elastic and dynamic response of the face under impact loadings is shown to influence the ball impact resultants (spins, velocities, and directions). That influence can be used to derive beneficial control of ball spins.

It is well known that elastic tailoring of the normal face stiffness can influence the COR of the clubhead-ball impact. This invention pertains to control of the system response in the transverse direction rather than the normal direction. Control of the transverse deformation of the system can be used to influence the ball speed, direction and particularly the spin of the ball resulting from the impact with the face.

Ball spin is determined by the tangential forces (along the face rather than normal to the face) which arise between the ball and the face. These forces are determined by the coefficients of friction between the bodies, the normal forces between the bodies (ball and face/head), and the relative motion between the ball surface and the face at the area of contact. This last contributor (the relative motion between the ball and the face) can be influenced by appropriate design of the elastic and dynamic response of the face under impact loads, both normal and tangential. This invention pertains to the design of the clubhead so as to create beneficial tangential motion between the ball and the face at impact by tailoring the elastic and dynamic motion response of the face under the impact loads.

To demonstrate how tangential face motion can influence spin, consider an idealized normal impact between a clubface and a ball, (i.e., the impact velocity vector is normal to the face). This type of impact will normally result in no ball spin. However, if the face is moved tangentially during the impact by impact forces, then spin can be induced in the ball. This spin can be positive or negative depending on the direction of tangential motion of the face under loading. In a like manner, face tangential motion can significantly influence ball spin above or below what would occur with a rigid inclined face (face with loft) where the impact velocity vector has both normal and tangential components initially.

The invention concerns the design of the elastic support of the face (or the elastic response of the face/head system itself) such that relative tangential motion between the club head and the face is induced by the ball impact forces. Depending on the elastic coupling in the system, the tangential motion of the face can be induced in the upward, downward, heelward, or toeward direction resulting in a wide variety of possible responses and induced (or diminished) ball spins. These can be used to for instance decrease spins during long drives and increase spins in iron shots.

In an alternate embodiment, the design of the elastic support, face, and body can be selected to decrease or increase the side spin on the ball resulting from impact. In these cases the face motion is tailored to be perpendicular to the dominant velocity resultant along the face but still tangential to the face normal direction. The face moves from side to side (heelward or toeward) under impact rather than up and down. This type of face motion can influence side spins on the ball resulting from impact. The side spins can dramatically effect hook and slice trajectories of subsequent ball flight. The side to side motion can be achieved through elastic coupling between normal forces on the face and tangential motion of the face. All these cases pertain to putters, drivers and irons equally and the term "club-head" will be taken to mean all of these without prejudice.

BRIEF DESCRIPTION OF THE DRAWINGS

The various embodiments, features and advantages of the present invention will be understood more completely hereinafter as a result of a detailed description thereof in which reference will be made to the following drawings:

FIG. 20 (comprising 20A, 20B, 20C, 20D and 20E) is a graphical presentation of the time histories of key parameters in the ball to club impact with varying face mass derived from the simulation showing A) impact normal force, B) impact tangential (friction) force, C) relative tangential velocity time histories, D) head spin time histories, and E) resulting ball spin time histories.

DETAILED DESCRIPTION OF PREFERRED EMBODIMENTS

Figure 1:
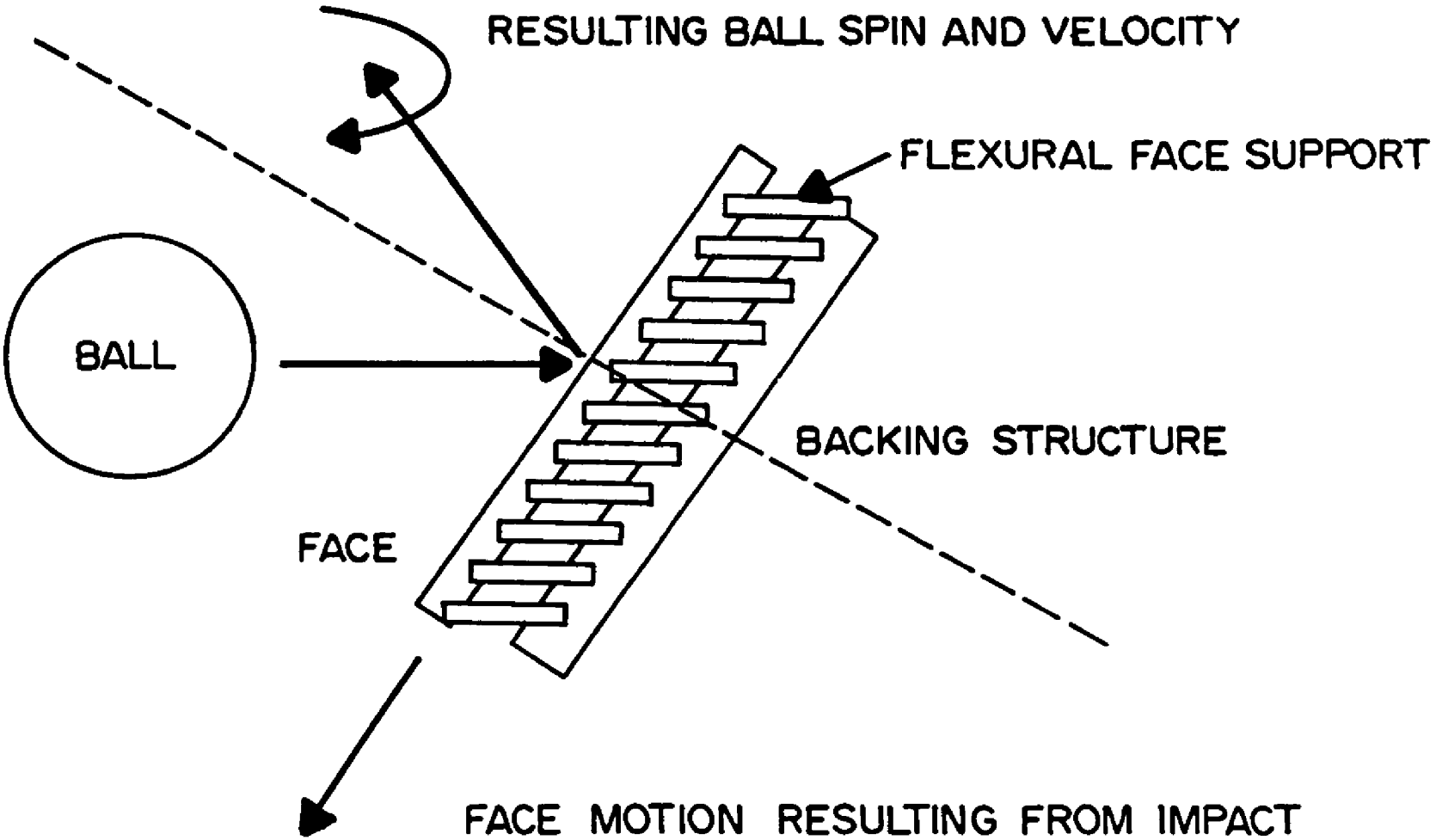
FIGS. 1 and 2 illustrate a conceptual embodiment of the invention wherein and elastic mount is disposed between the face and body of the club elastically connecting the face relative to the body.

It is an objective of this invention to provide a method and apparatus for controlling the ball spin resulting from the club head-ball impact by using the elasticity and dynamic deformation response of the clubhead under the impact loading. The impact load induced head deformation and subsequent motion of the ball contact surface, hereafter the face, relative to its point of contact with the ball has profound effect on the multi-axial spins and velocities of the ball, hereafter the impact resultants. This invention comprises a method and apparatus using face elastic and dynamic response that controls (increases or decreases) spin on the ball. The method can be adapted to control both topspin and sidespin.

During the (potentially oblique) impact between the ball and the head there are high forces at the point (or over the area) of contact between ball and the face. These forces can be resolved into those aligned with the face normal (hereafter normal forces) and those components tangential to the hitting surface or face (hereafter tangential forces). The normal direction can be arbitrary in space and the tangential direction can be anywhere in the plane perpendicular to the normal direction. These forces can be up the face or down, toeward or heelward, depending on the face orientation and ball and face motion. Note that these directions are defined relative to the local normal and tangential plane for a curved hitting surface and no generality is lost in this application to a curved hitting surface.

The normal component of the force acts through the CG of the ball and accelerates the ball during impact. The tangential component of the forces act at the point(s) of contacts between the ball and the face perpendicular to the normal direction and therefore can be resolved into equivalent torques on the ball about the CG (affecting the ball spin) as well as forces that contribute to acceleration of the CG directly. The tangential forces induced by impact therefore have complete control of resultant ball spin as the torque integrates over time to create rotational velocity of the ball. The torque overcomes ball rotational inertia as is well known in the art in the Euler Equations for the 6 degree of freedom (DOF) equations of motion for the dynamics of a freely rotating and translating rigid body under external torques and forces. It is an object of this invention to tailor these forces during impact by appropriate design and tailoring of the transverse elastic and dynamic response of the club head face during impact.

The forces of impact, both normal and tangential are determined by a number of factors including initial velocities of the impacting bodies, masses of the bodies, as well as elasticity and dynamics of the bodies. It has been shown that normal response (COR) of the club head and ball impact can be improved by tuning of the normal dynamics of the system. This invention pertains to optimal selection of the transverse elastic and dynamic response of the club head.

To see how the elasticity of a body can determine the force time history during impact, consider a rigid face with a very soft but lossless support in the normal direction. During normal impact (non-oblique) the softer support allows more deflection between the face and the impacting ball (the face deforms away from the impacting ball), resulting in longer dwell times and lower interface forces. Thus face elastic response has a major influence on force time histories.

Consider the case of an oblique impact with tangential forces as well as normal forces. The tangential forces arise from the tangential component of the impact velocity vector that occurs in oblique impacts. When resolved into the face coordinate system the point of contact between the ball and the face is moving both in the normal and in the tangential direction. The tangential relative velocity between the face and the ball at their point of contact gives rise to tangential forces from the friction between the face and the ball. If there were no friction between the bodies, there would be no tangential forces and no change in spin of the ball from its initial condition.

The friction forces between two bodies depend on a number of factors including the normal forces between the bodies, the friction coefficients between the bodies as well as the relative motions/velocities between the bodies. For example traditional Coulomb Friction between two bodies takes its magnitude from the product of the Friction Coefficient and the normal force and its direction from the relative transverse velocity vector between the two bodies.

Coulomb Friction Equation and Others

Other models have a component of the force whose magnitude is dependent on the magnitude as well as the direction of the relative tangential velocities between the two bodies. In any model the relative tangential velocity between the two bodies plays an important role in determining the magnitude and direction of the tangential force.

This tangential force in turns effects the relative tangential velocities between the ball and the face. The tangential force on the ball acts both as a force at the CG in the tangential direction (accelerating and changing the velocity of the CG of the ball in the tangential direction) and a torque about the CG of the ball acting about an axis perpendicular to both the normal and the tangential velocity vectors. This equivalent torque acts to change the spin of the ball.

In most scenarios the ball is initially not spinning at impact. The tangential velocity from an oblique impact as well as the normal force act to create a tangential friction force that spins up the ball. It creates ball spin since it acts not at the CG but at the contact points between the ball and the face. So at start of impact the ball is essentially sliding up the oblique face and the sliding forces act to start the ball spinning. As the tangential forces increase the ball spin, in many cases the ball spin can increase to the point that at the point of contact between the ball and the face there is no longer any relative motion. The ball is rolling up the face with no more sliding (and no friction force) between the face and the ball. This is called the rolling condition and generally determines the final spin on the ball as it leaves the face.

In this invention elastic design of the club head allows the face to respond to the tangential forces as well. In a system where the face can respond tangentially (as well as the ball changing spin) there is a new contributor to the relative velocity between the face and the ball surface. Since the face now contributes to the relative velocity between the ball surface and the face, its motion can dramatically effect the friction between the bodies and the resulting tangential forces and ball spins. This is the core concept of the invention.

To achieve this tangential face motion, the club head is designed such that the hitting surface (face) can have tangential motion relative to the bulk of the body of the club head. In such a system, there is an elastic connection between the face and the club head body (or elasticity of the club head body and face themselves) that is tailored for the proper response under impact loading. This response can be varied depending on the application. For instance, if it is desired to increase spin, the elasticity can be tailored such that the face moves opposite to the tangential velocity vector of the ball. This increases the relative tangential velocity between the ball and the face and the ball must spin more rapidly to match this higher relative tangential velocity before it reaches the rolling condition and no longer accelerates rotationally.

In another manifestation of the invention, the face can be elastically mounted such that it moves in the direction of the ball tangential velocity vector under the impact loads. This decreases the relative tangential velocity between the ball surface and the face, resulting in a lower spin necessary to reach the rolling condition.

It is important to consider the time history of the face motion and therefore the time history of the relative tangential velocity vector in determining the time histories of the frictional forces between the ball surface and the face and therefore the final ball angular velocity vector (spin rates). In some scenarios the velocity of the face relative to the body can reverse or change considerably during the course of the impact event dramatically affecting the resultant ball spin. It is therefore important to consider the time histories and dynamics of the elastic club head in design for a given application.

A critical element of this invention is a contact surface (face) of the head elastically/resiliently supported on the body wherein contact forces between the ball surface and the hitting surface induce movement in the face relative to the body of the club head. There are fundamentally two types of elastic support for the face characterized by whether the forces and motions in the normal and tangential directions are elastically coupled or uncoupled. These two classes will be described in the following sections.

Uncoupled

In this class of system, the normal forces on the face produce deformation of the face only in the normal direction not in the tangential direction. Likewise tangential forces on the face produce only tangential motion of the face. These motions are understood to be elastic deformations of the face and not those associated with global rigid body motion of the head under the impact loads. There is thus no coupling between the normal deformation and loads and the tangential deformation and loading. The system is said to be uncoupled.

In the design of this type of system, shown conceptually in FIG. 1, the club head designer need only consider the transverse stiffness and transverse response of the club head system under the transverse loads and the design is greatly simplified. The transverse loads are typically lower than the normal loads, however, and so the available forces and resulting deformations of the system can be lower, all stiffnesses being equal.

Coupled

In this class of system the effective stiffness matrix for the support of the face is coupled such that normal forces produce both normal and transverse deformation of the system and normal and transverse motion of the hitting surface. By appropriate design of the elastic support (for example by the tilted support described in FIGS. 2 and 3), this coupling can be made to produce varied transverse motion of the face under impact loading, upward, downward, heelward and toeward, relative to the club head depending on the tilt in the supports.

This elastically tailored transverse motion can be used to dictate the relative sliding motion between the face and the ball and increase and decrease spin in these directions.

This coupling can thus be of great use to the designer in creating a wide range of ball spin resulting from the impact since the face motion (for instance up or down the club) can be easily controlled resulting in a wide range of relative motions between the face and the ball and therefore a wide range of ball spins. Face coupling can be used to create topspin on the ball, null out the ball spin, or increase the ball spin as described in the following sections.

Preferred Embodiment

One specific method and apparatus for achieving the effects described above consists of a clubhead comprised of a face and a body wherein the face is supported on elastic mounts in a number of possible configurations. Under impact there is relative motion between the hitting surface (face) and the body due to the elasticity of the supports. In one manifestation, the supports form an elastic connection between a backplate which interfaces between the clubhead body and the backside of the supports and the backside of the face, FIGS. 2 and 3. The supports can be screwed, welded, press fit or otherwise attached to both the body structure and the face in such a way that they are closely mechanically coupled. In the preferred embodiment the support is elastic and has low damping, but there is the possibility of introducing damping in the interconnection between the face and the body to achieve desirable feel in the club head.

Figure 2:
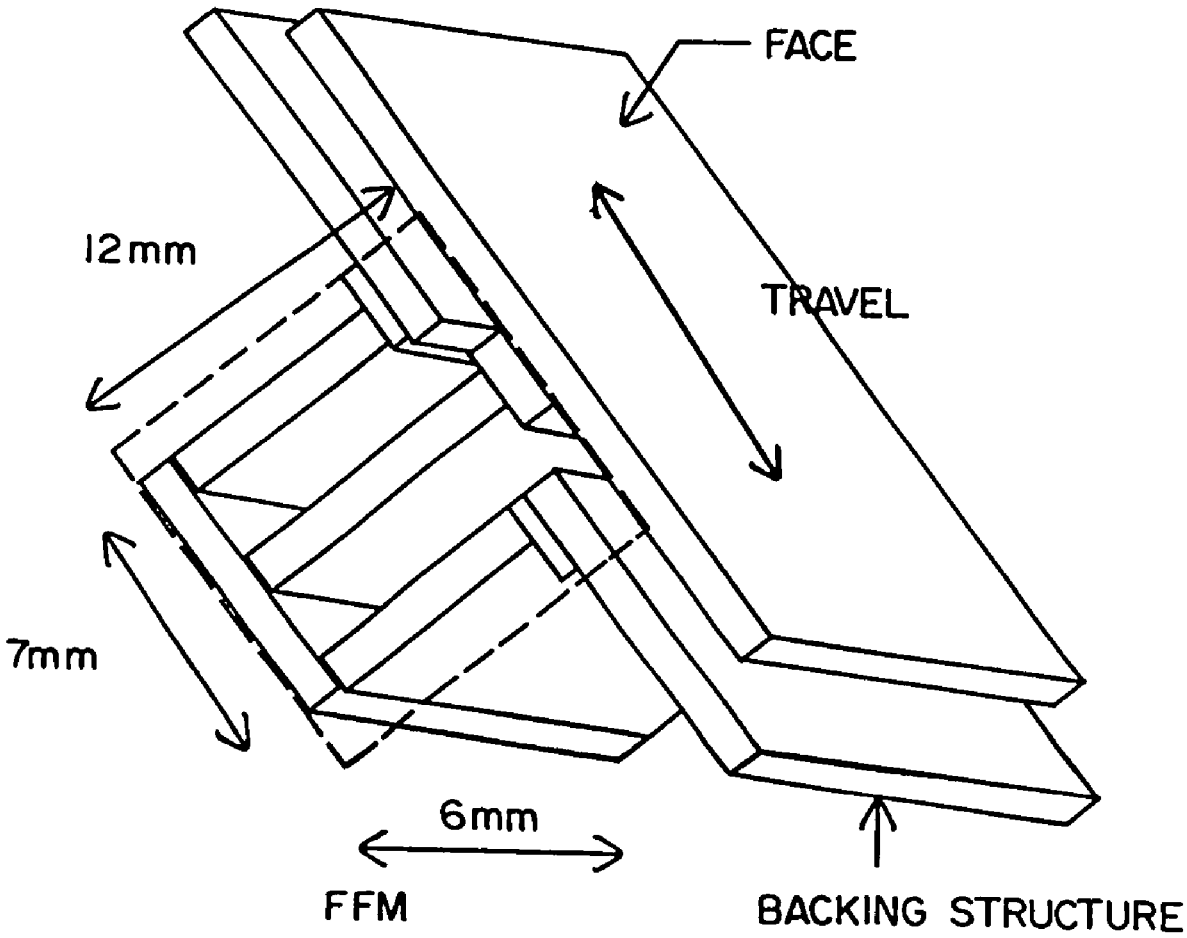
Figure 3:
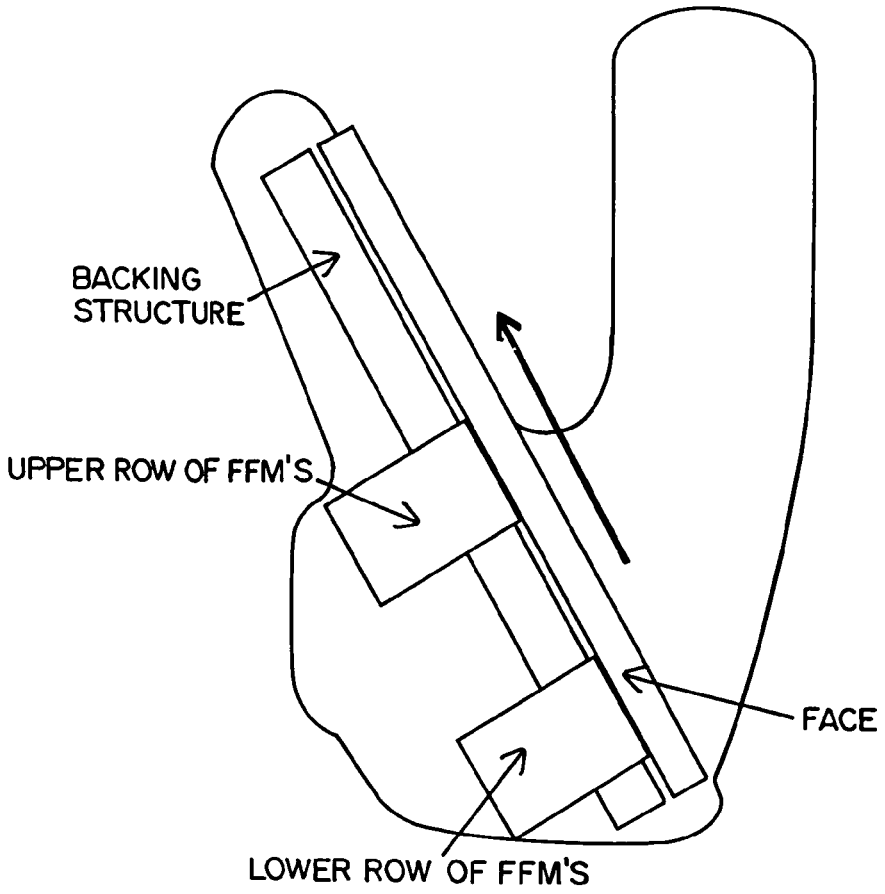
FIGS. 3 and 4 are detailed illustrations of an iron clubhead showing placement side and face views of a particular embodiment of the elastic face mounting system and elastically supported face.

One possible form of the support as described above is a series of beams, ribs or posts supporting the face above the body of the club. The supports can be distributed across the face surface to tailor the face motion during impact as shown in FIGS. 2 and 3. For instance they can be distributed to present the same normal stiffness across the face regardless of impact location or to tailor the effective normal stiffness as a function of the impact location of the club. For instance making the face act softer in the normal direction along its periphery. In addition, the supports can be arranged to allow only nearly pure translation of the face in the tangential direction as shown in FIG. 2.

The beams, ribs or posts can be aligned so that their major axis is parallel to the direction of the normal impact forces, FIG. 2. In this case these normal forces are taken axially by the supports and transverse impact forces are taken in bending of the supports (FIG. 2). In this configuration the elastic support is in the uncoupled class and normal forces do not produce substantial transverse deflections. In this type of support, the bending stiffness of the supports can be tailored such that the tangential motion of the face acts to either increase or decrease the ball spin as will be described below.

Alternately the major axes can be slightly tilted from the normal direction so as to take both normal and tangential forces both as axial loads on the support as well as bending loads. This inclined orientation shown in FIGS. 2 and 3, leads to coupling between face normal loading and face tangential motion. The degree of tilt of the supports and the direction of tilts of the supports can be used to tailor the elastic coupling between the face and the body and achieve a wide range of desirable face motions under impact loading. In particular the tilted supports allow a normal force to create a large tangential motion in the direction of the tilt of the supports. This can be used to launch the face in the particular tangential direction, allowing it to return to its original condition/location toward the end of the impact event. This can be important for tailoring ball spin at the end of the impact event when normal forces are lower.

In one manifestation of the support, the individual supports consist of beams attached to both the backside of the face and the body of the club, FIG. 2.

Figure 4:
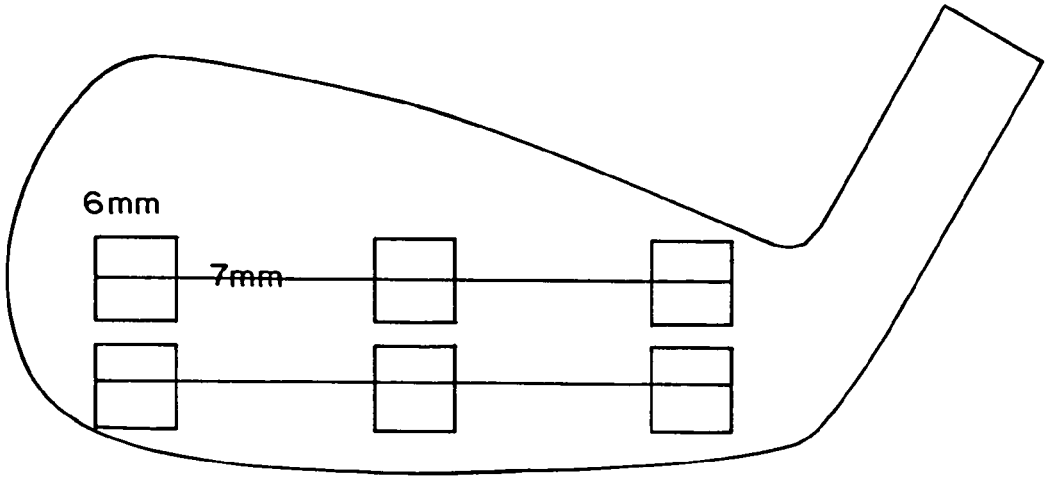

In the preferred embodiment as shown in FIGS. 3 and 4, there is a baseline separation of the face from the backing structure for the design of 2.0 mm (in the range from 0.25 to 4 mm) that allows for a large off center hit without any face tilting and contact or interference issues. There is also the possibility of introducing mechanical stops for the face motion in either the tangential directions or the normal directions (or both) so as to limit the deflection and stress that the elastic mounts will see during impact, i.e., to protect the elastic mounts. For example consider a skulled shot. Here the loading is far from the 9000/2000 (N normal/N tangential) and more like (4000 N/4000 N) which could damage the mounts if the motion is not constrained.

In the preferred embodiment, the elastic mounts can be arranged in two rows of mounts totaling between 96 mm and 80 mm of the extruded shape. In an arrangement of two rows, a typical 5 iron handles 90 mm total length of the support in a 40/50 (top row/bottom row) as shown in FIGS. 5-11. This allows the mounts to be manufactured as an assortment of 20 mm and 10 mm mounting modules arranged such that there would be 2-20 mm units on top, and 2-20 mm units and 1-10 mm unit on the bottom row to support the face. The elastic support modules can be allowed to butt up against each other. It is possible to narrow the 'moving' portions by a few thousandths of an inch to minimize rubbing.

Elastic Mount Module Design Specifics

Figure 5:
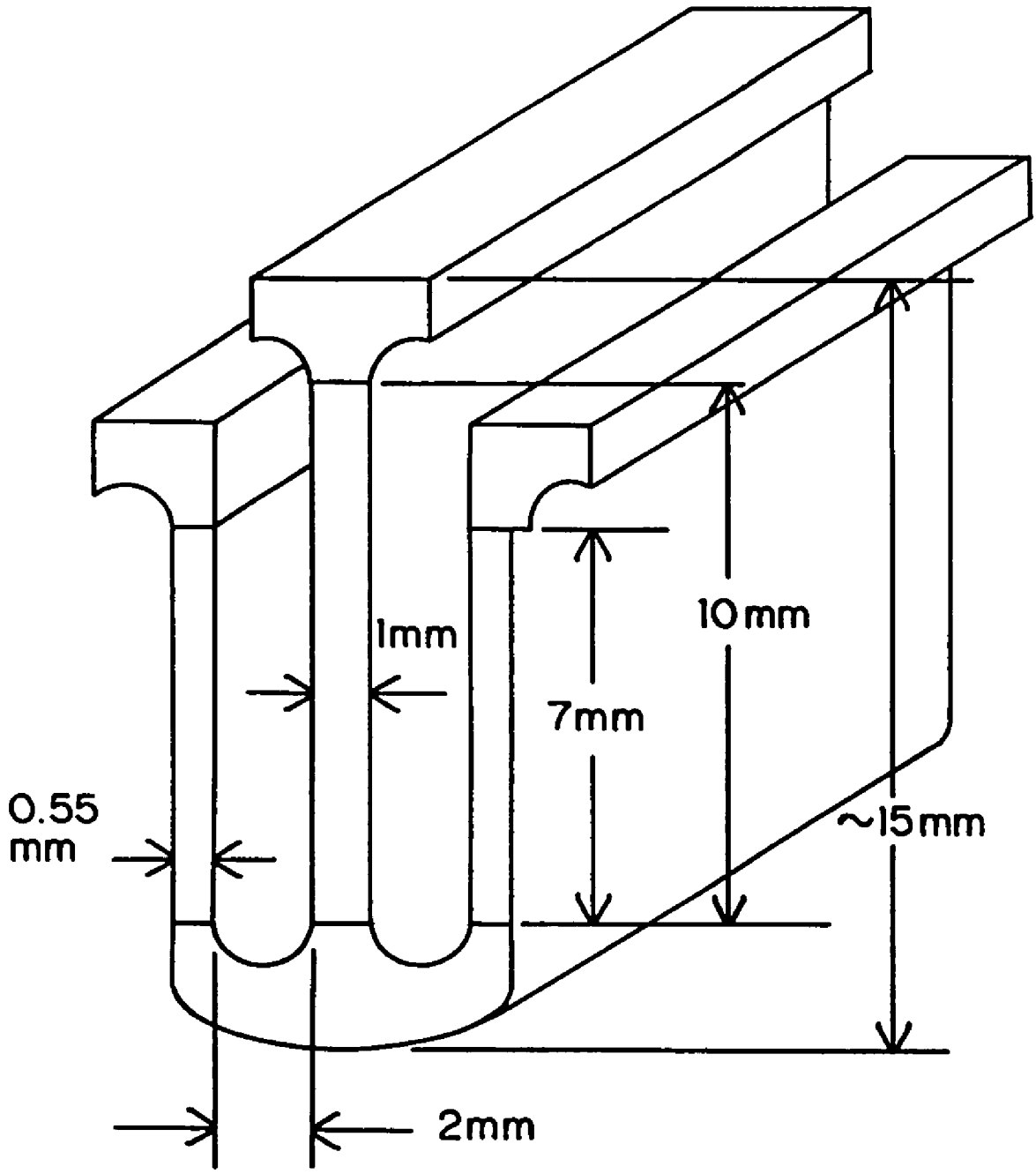
FIGS. 5 and 6A and 6B are detailed illustrations of a particular embodiment of the elastic mounting module for an elastically supported face.
Figure 6B:
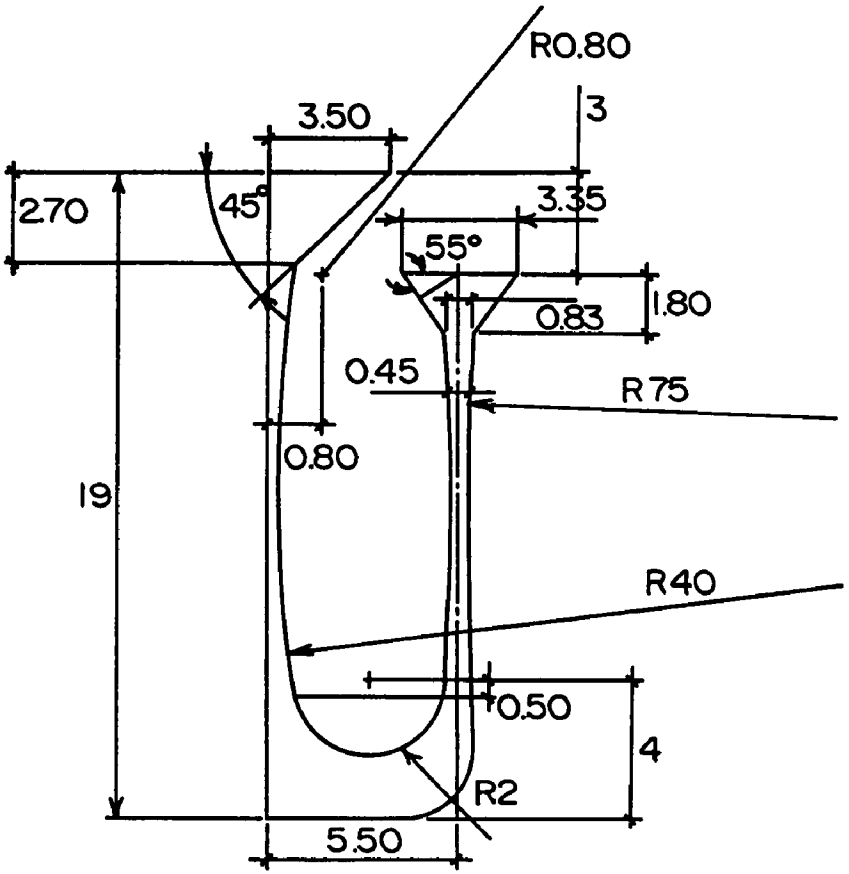
Figure 6A:
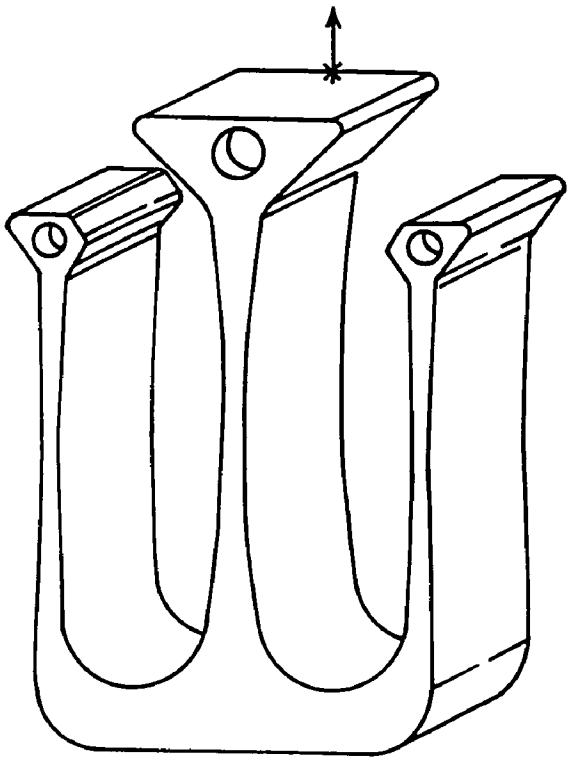
Figures 7A, 7B:
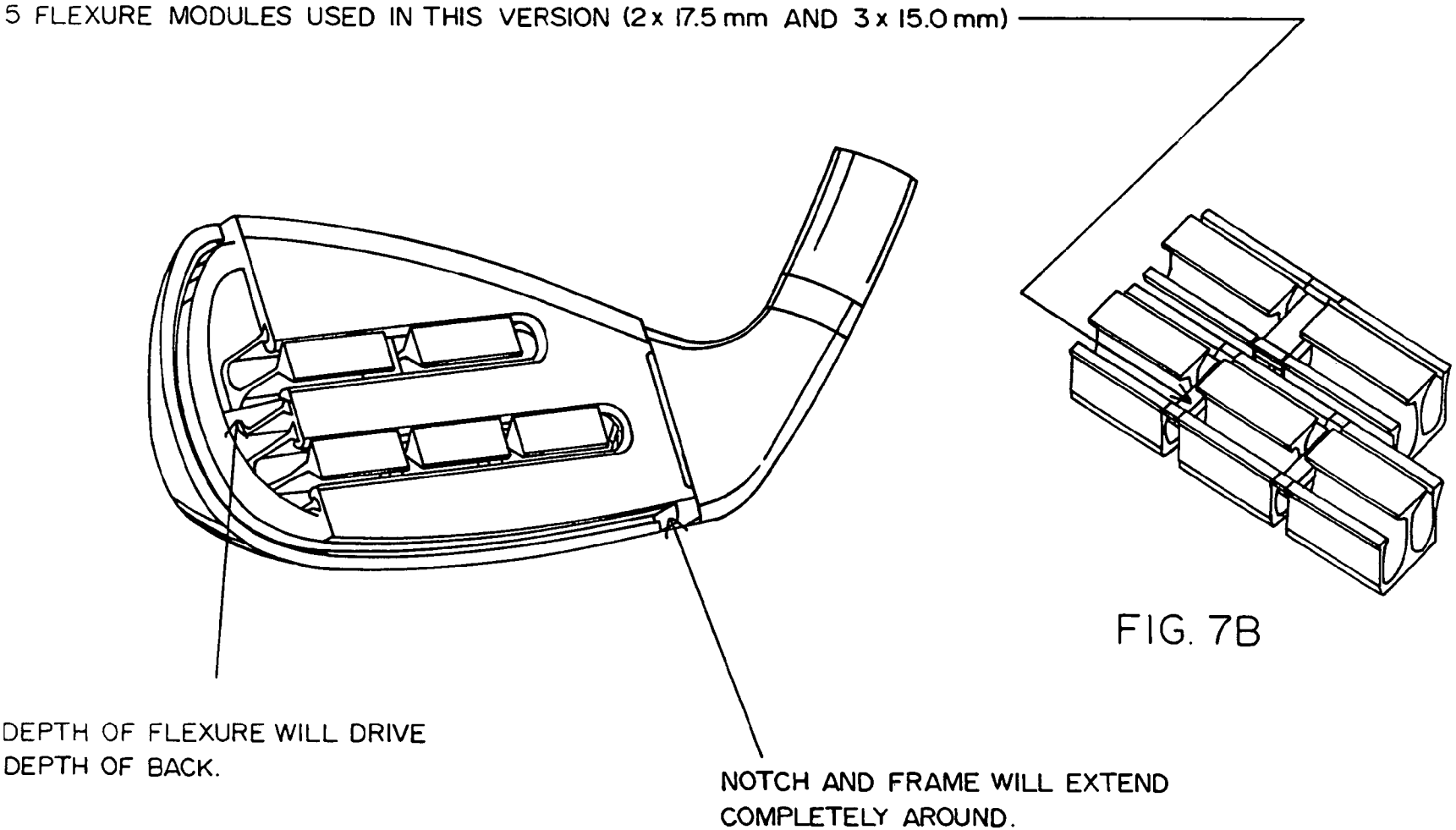
FIG. 7 (comprising 7A and 7B) illustrate the flexure modules and face interface in an iron.
Figure 8B:
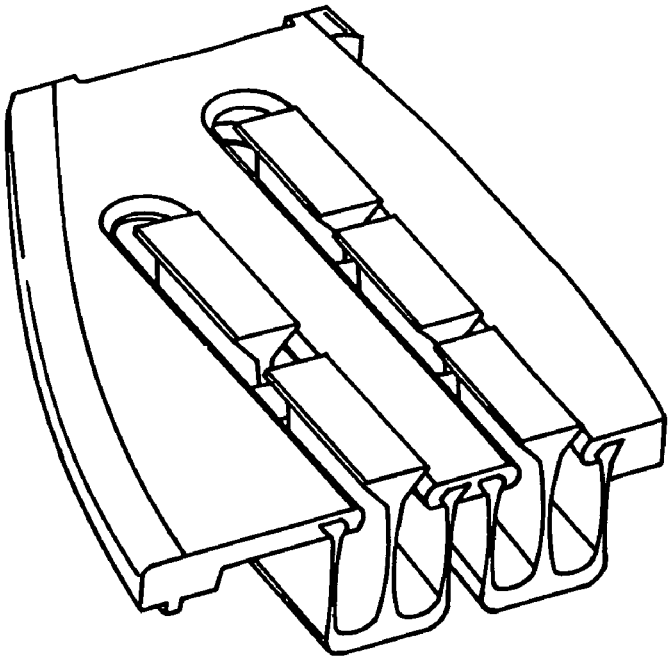
FIG. 8 (comprising 8A and 8B) show the clubhead and face with seated flexures.
Figure 8A:
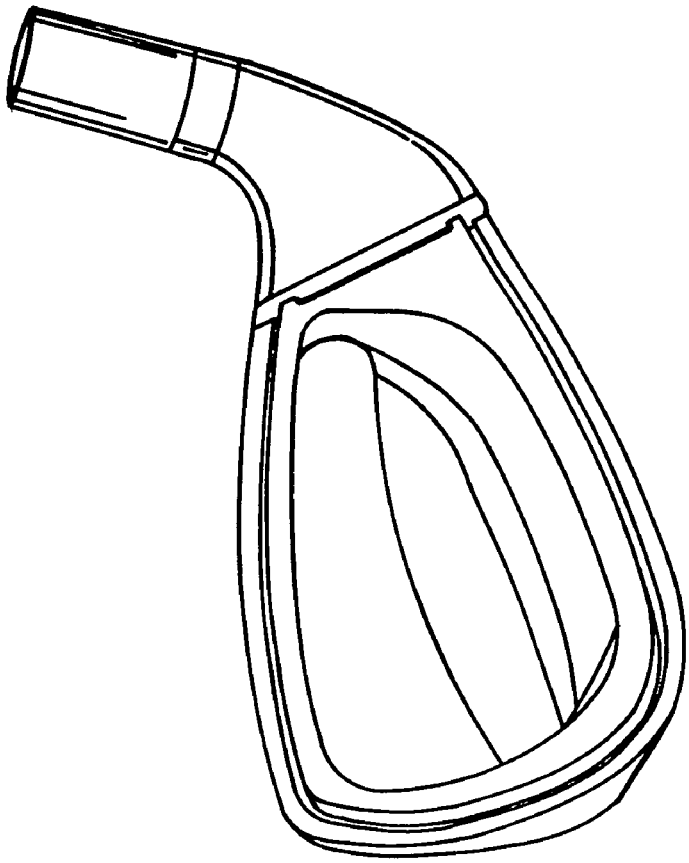

In the preferred embodiment, the elastic mount modules (EMM) consist of three bending beams arranged in a folded beam structure as shown in FIGS. 5 and 6. In this arrangement one end of each of the outer two beams is connected to the body backing structure. They project below the backing structure to a connection stage. The connection stage acts as a movable platform onto which the central beam is attached on one side. Because the connection stage is supported by two beams symmetrically, it predominately translates parallel to the face. Normal direction loads and deflections are born axially by the beams. The inner central beam takes the impact loads in compression while the outer beams take the impact normal loads in tension. Both sets of beams (the inner and outer) take transverse load in bending (as long as the entire module is aligned with the normal direction for impact loading. It can be tilted as described previously to create an elastically coupled support module. The central beam is connected from the connection stage to the backside of the housing forming a single elastic mount module which extends as a prismatic extrusion in a direction perpendicular to the beam bending direction as shown in FIG. 5. The modules can be manufactured in a variety of extruded lengths depending on the desired modularity and design stiffnesses.

The design of the elastic support module is intended to provide a design normal and tangential stiffness (our coupled stiffness) such that the desired motion is achieved under impact loading scenarios. The desired elasticity (described below) must be met with a system that meets the criteria for structural integrity under that loading. That is, the system must take the loading without permanent (yield) deformation or buckling. The design presented in FIGS. 5 and 6 meets these criteria.

The design shown in FIG. 5 was of the uncoupled type. It has a target tangential stiffness of 21.4 N/mm/mm or (2050 N/mm per 96 mm length), and achieves a tangential stiffness of 23.9 N/mm/mm or (2300 N/mm per 96 mm length) as designed. The design has a target normal stiffness of 2140 N/mm/mm or (205000 N/mm per 96 mm length) or approximately 100× the tangential stiffness. The design as described achieved a normal stiffness of 2188 N/mm/mm or (210000

N/mm per 96 mm length) or about 91×tangential. With these achieved stiffnesses, under a 9000/2000 N loading (normal and tangential), the deflection of the ESM is (0.042 mm/0.870 mm) for a 96 mm long extrusion of the cross section show in FIG. 5. The normal displacement is quite small due to the high normal stiffness of the design while the tangential displacement under the quasi-static 2000N load in almost 1 mm.

The challenge of this design was to achieve these elastic constants in a structurally robust design. The material selected for the elastic support module was Ti-4Al-6V material for its high specific strength and high yield stress. Other materials such as steel or alternate titanium alloys could be used. Under combined normal and tangential loading described above, the peak stress in the design was 940 MPa which is below the yield stress for the material. In addition to stress analysis, the elastic support module (ESM) must be designed to resist buckling of its inner column under the compressive impact loads. Analysis revealed that the buckling load margin for this design (buckling load/peak load) is 3.6 for this design. Thus the module meets the desired elastic behavior without compromising structural integrity.

The preferred manufacturing process is wire EDM (electro discharge machining), with standard surface finish. Although other standard machining or forming processes, such as plunge EDM, could be used as long as they produce parts of the requisite strengths. The design presented in FIGS. 7-11 has an overall depth, front (face) to back (connection stage), of 19 mm, and a total of 90 mm extruded length in modules of 20 and 10 mm length arranged in two rows on the face of the club. This allows translation of the face up the club and high stiffness in the normal or alternate tangential directions. In the present design, the face mass is 41.6 grams. The stiffnesses were chosen as above such that the first natural tangential frequency of the face motion is approximately tuned to the duration of the impact event. The precise tuning condition is described below in the section on tangential stiffness tuning conditions.

A critical element of the preferred design is the attachments between the body backing structure, the face structure and the Elastic Support Module (ESM). In order to achieve the design elastic constant for the system, there can be no extra compliance at the interfaces between the ESM and the face and the body. This implies that the fits must be tight (potentially bonded with epoxy) or soldered or welded together so that the system acts as a unitary body with little play or additional compliance at the joint. In the preferred embodiment the ends of the beam of the ESMs are designed with wedge shaped dove tails which fit into corresponding matching groves in the face and backing structure. A cross section of the face, ESM and body mounting structure is shown in FIGS. 7-16. It shows the two folded beam ESMs as well as the interfaces to the backing structure and the face. The interfaces can be held permanently with epoxy or simple set screws to preload the interface between the ESM and the face and body.

The ESMs have beam structures of variable thickness along their length designed to minimize the stresses in the beams under the impact loads. This feature thins the beam near their centre and thickens them at the ends. This type of thickness variation is appropriate to beams undergoing this type of motion, i.e., a classical sliding-sliding beam boundary condition with no angular deflection at the ends only sliding translation in the tangential direction. In this type of motion the peak bending stress is born at the clamped-sliding ends and there is little load at the center. The center can therefore be thinned since its material is only lightly stressed. As additional design features, the face is tapered in thickness to allow for additional clearance between the face and the backing structure at the outer edges of the club. This is to accommodate highly eccentric shots where the normal loads are taken far from the locations of the two ESM rows. In this scenario the face is cantilevered off of the two ESM rows and appears slightly softer in the normal direction.

In the preferred embodiment the backing structure is very stiff and provides little additional compliance to the system. A central rib nominally 2.0 mm wide at base×4.0 mm high) is added between the ESM rows providing this stiffness. It should be noted that some compliance can also be designed/allowed in the backing/support structure but then this compliance must the accounted for in the flexure elastic tailoring so that the total system elasticity is at the optimal value. Finally in the present design 2.14 mm of side to side motion of the face can be tolerated before contact is made between the outer beams of the ESM and the edges of the backing structure. This is determined by the cut-out width in the backing structure.

Putter Application

In putting it is known in the art that the key to reducing skid is to give the ball as much topspin as possible before it leaves the putter face and it is advantageous to minimize the distance that the ball skids before it starts to roll.

Driver Application

In driving it is known in the art that the key to increasing ball flight distance and reducing cross range travel in high velocity impact scenarios is to reduce ball topspin to avoid excess lift in the high velocity impacts.

Nonlinear System Modeling

Figure 9B:
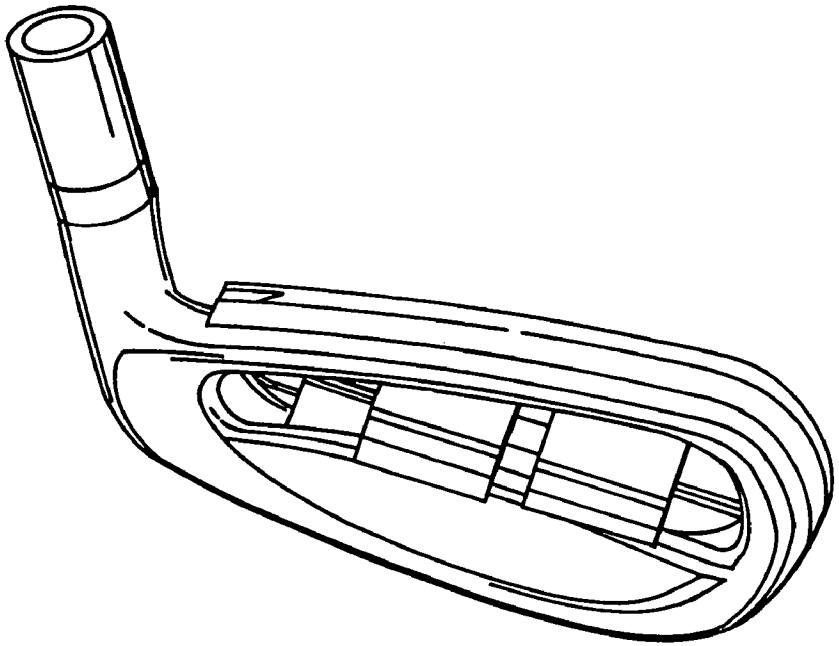
FIG. 9 (comprising 9A and 9B) is a schematic of the model used for simulation of the ball-clubhead impact event with tailored face-body elasticity, ball elasticity, and full 6 DOF.
Figure 9A:
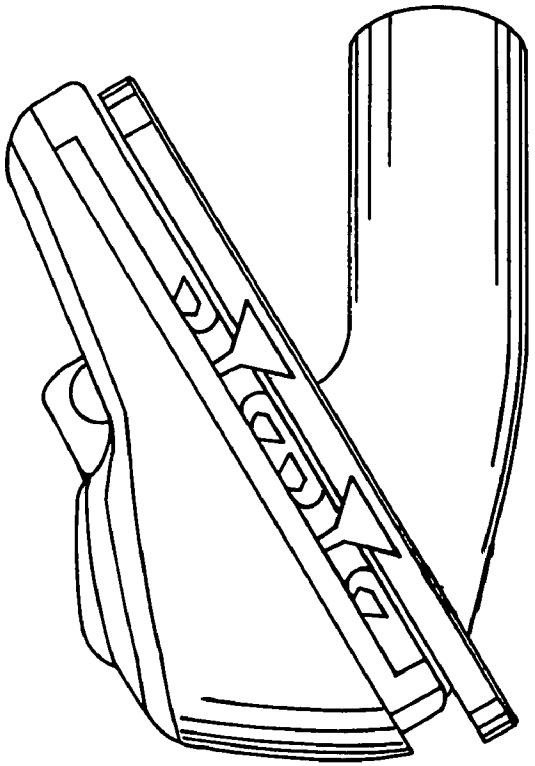
Figure 10B:
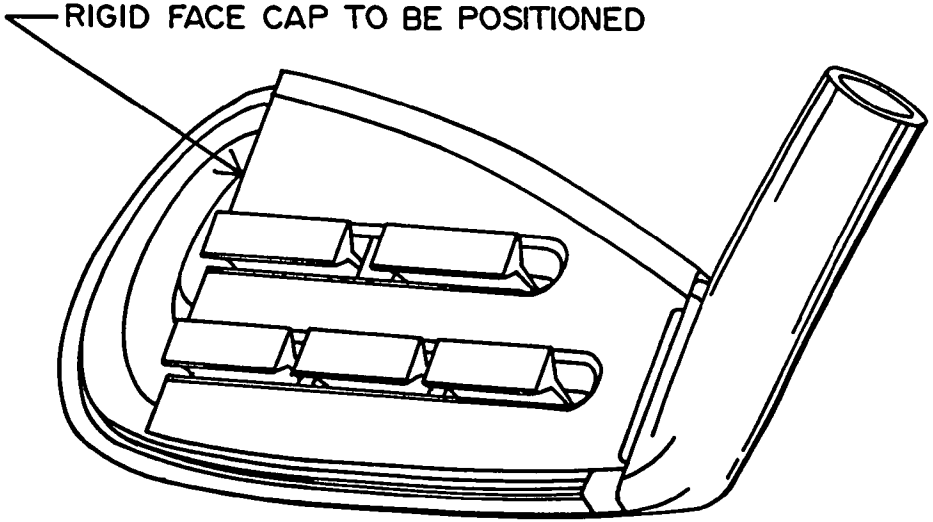
FIG. 10 (comprising 10A and 10B) show further views in cutaway of the face cap and flexure interface.
Figure 10A:
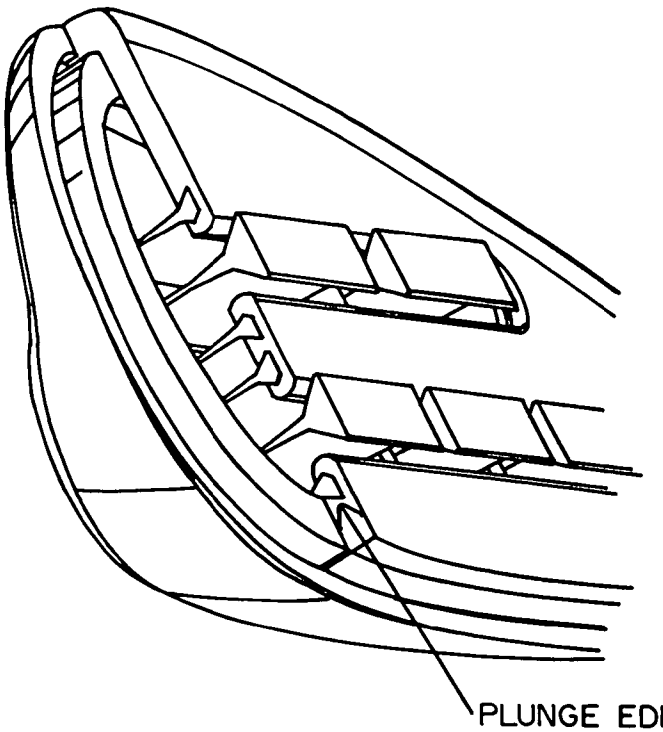
Figure 11:
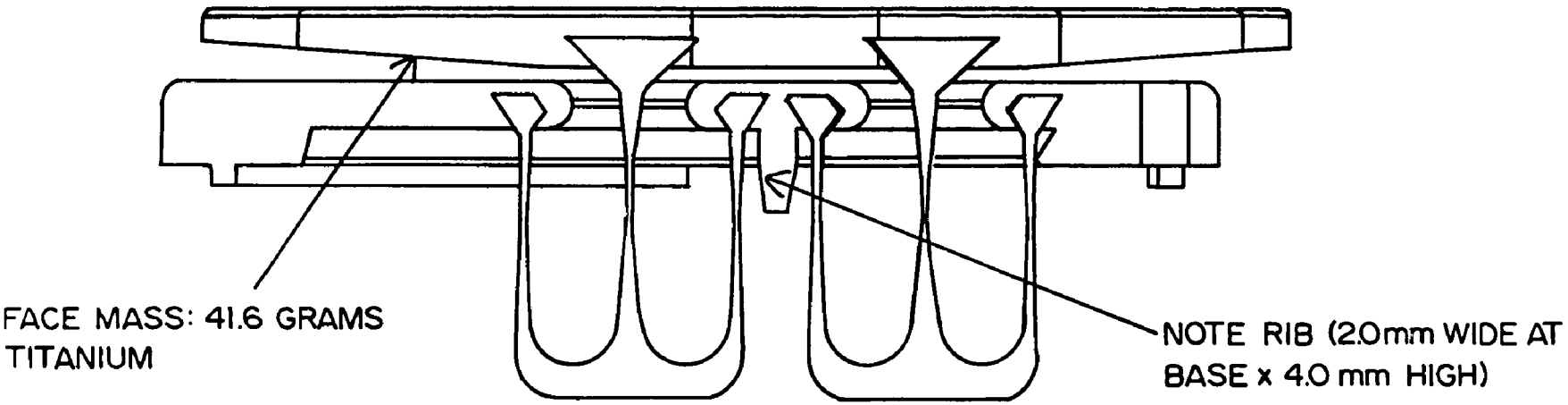
FIG. 11 is a schematic edge view of the face/flexure interface.

In this section a model for simulation of the impact between an elastic deformable ball and a clubhead with an elastically tailored face support between the face and the body will be described. The geometry for the model is shown schematically in FIG. 9. The system consists of several components including an elastic ball in contact with a rigid face elastically supported on a rigid clubhead body free to rotate and translate in space. As for the clubhead, the body is represented by a full 6 dof (3 translation and 3 rotation) rigid body which responds to forces introduced on it through the elastic supports for the face. The face in turn is responding to both the support forces and is in contact with the ball. As shown in FIG. 9 the face is allowed to move as a rigid body relative to the clubhead body in the normal and transverse directions relative to the face normal direction. The elasticity of the supports is represented by a 2×2 stiffness matrix or 2×2 compliance matrix:

$$[x_n\ x_t]^T=\{K_{nn}\ K_{nt};\ K_{tn}\ K_{tt}\}^{-1}[F_n\ F_t]^T$$

Where $x_n$ is the normal deflection of the face relative to the body, $x_t$ is the tangential deflection of the face relative to the body, $F_n$ is the normal force on the face caused by ball impact, $F_t$ is the tangential force on the face caused by ball impact, and the K's are the respective elements of the elasticity matrix for the face support.

The ball starts initially at rest with a moving clubhead at specified head speed which comes in contact with the ball as the clubhead advances. The model considers contact forces in the normal and tangential directions where the tangential direction is defined by the direction of ball rolling/sliding on the face. This is determined by initial clubhead orientations and velocities as well as the geometry of the face. The ball starts initially at rest and the normal impact forces and tangential friction forces induce velocity to the ball CG and spin about the CG. Ball compression and losses are modeled using accepted visco-elasticity models and a single compression mode representation of ball dynamics. The model represents a system of nonlinear equations with initial conditions consisting of ball and head velocities and orientations. The time history resulting from these coupled nonlinear dynamic equations are solved numerically as a function of time using numerical integration techniques in Matlab Simulink toolbox. The model allows exploration of the dominant effects in the ball head impact and its results highlight the optimal design qualities and preferred configurations for a given effect on ball spins.

Case Studies

A number of case studies were preformed, varying parameters such as face mount elasticity, face mass, and ball/face coefficient of friction. When not otherwise stated the results are for a nominal 5 iron with 27 degree of loft at 10 gram rigid face.

Figures 12A, 12B, 12C, 12D, 12E:
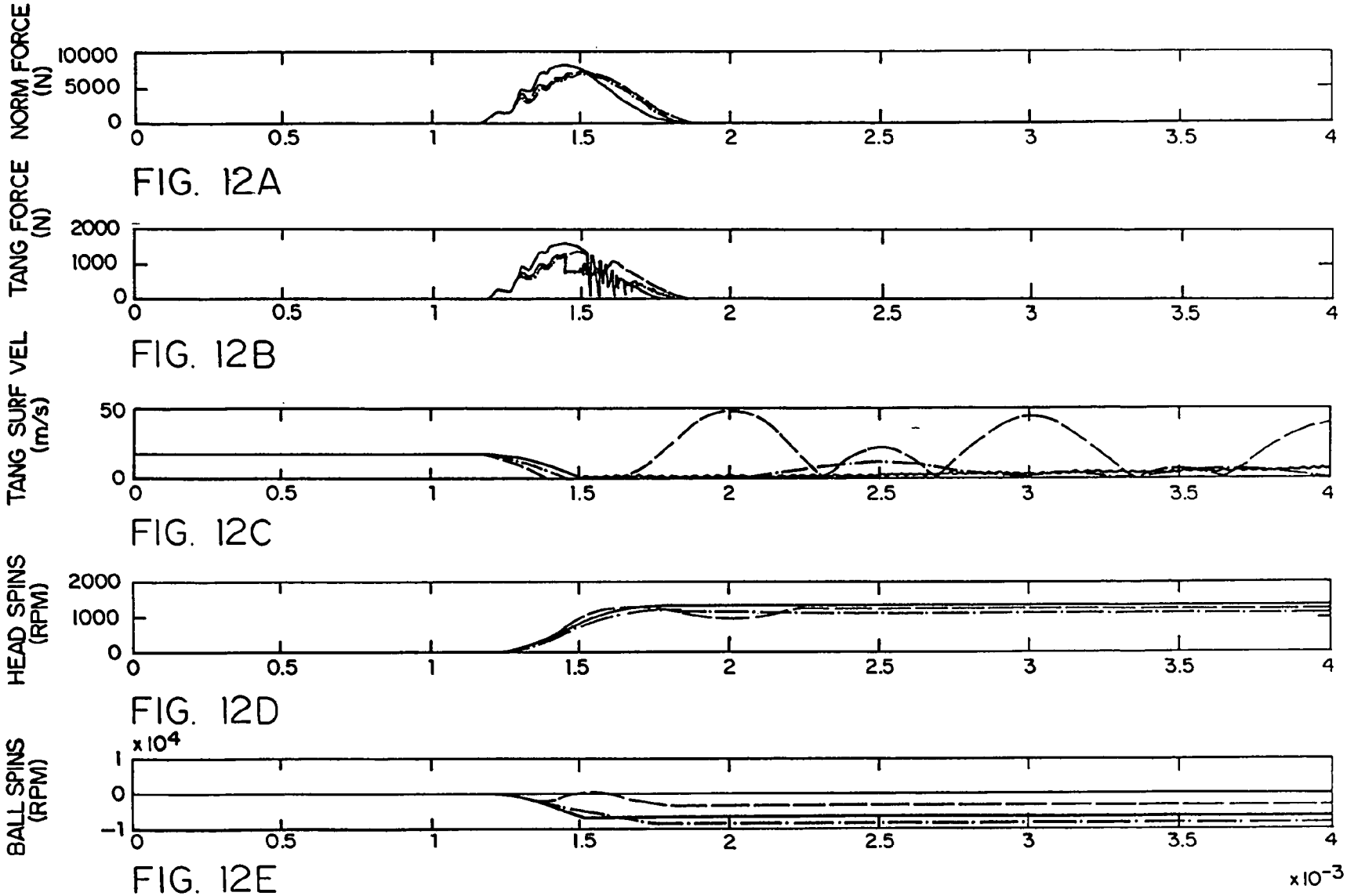
FIG. 12 (comprising 12A, 12B, 12C, 12D and 12E) is a graphical presentation of the time histories of key parameters in the ball to club impact derived from the simulation showing A) impact normal force, B) impact tangential (friction) force, C) relative tangential velocity time histories, D) head spin time histories, and E) resulting ball spin time histories.
Figures 13A, 13B, 13C, 13D, 13E:
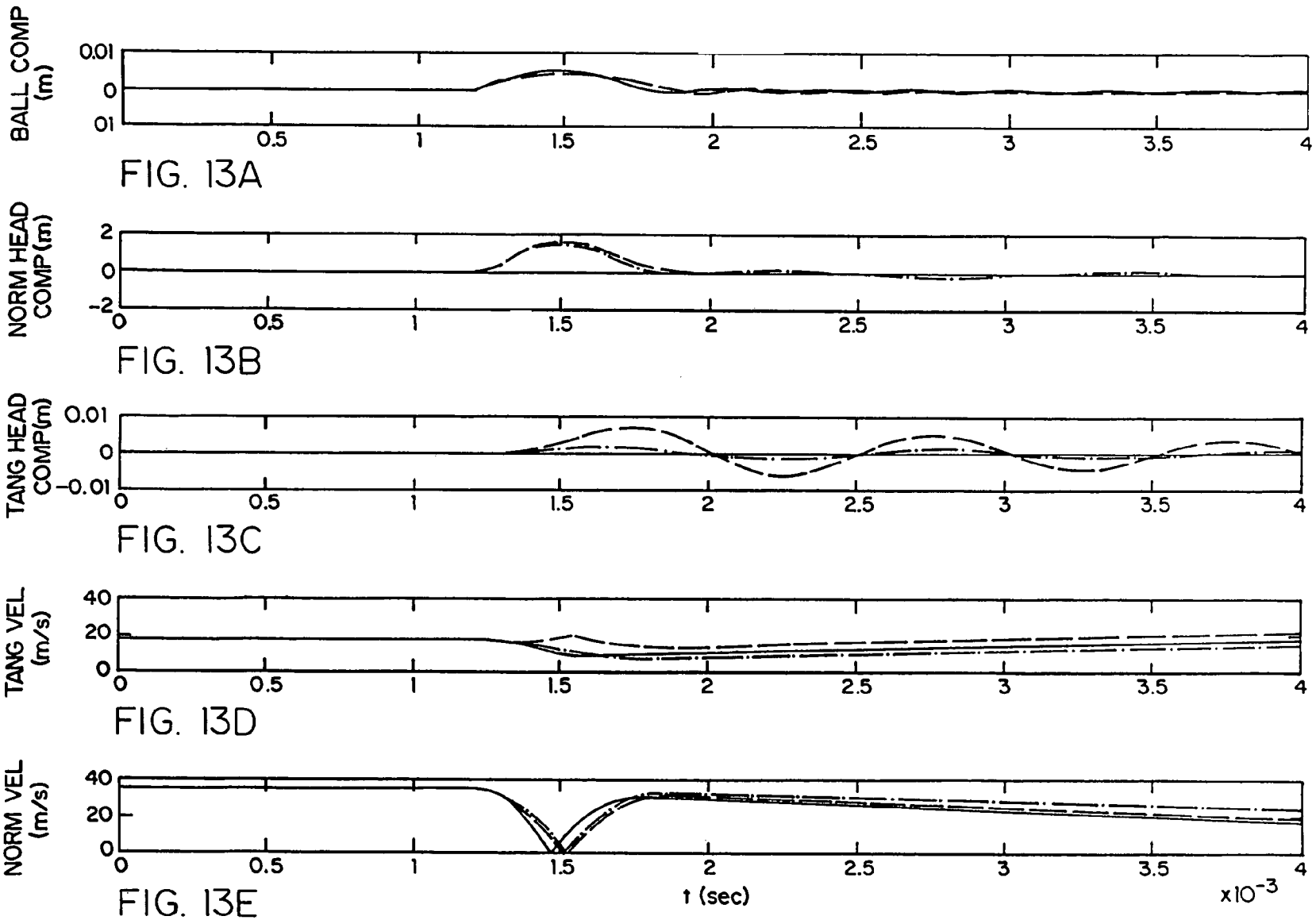
FIG. 13 (comprising 13A, 13B, 13C, 13D and 13E) is a graphical presentation of the time histories of key parameters in the ball to club impact derived from the simulation showing A) ball elastic deflection, B) relative normal face deflection, C) relative tangential face deflection, D) tangential ball CG velocity time histories, and E) normal ball velocity time histories.
Figures 14A, 14B, 14C, 14D, 14E:
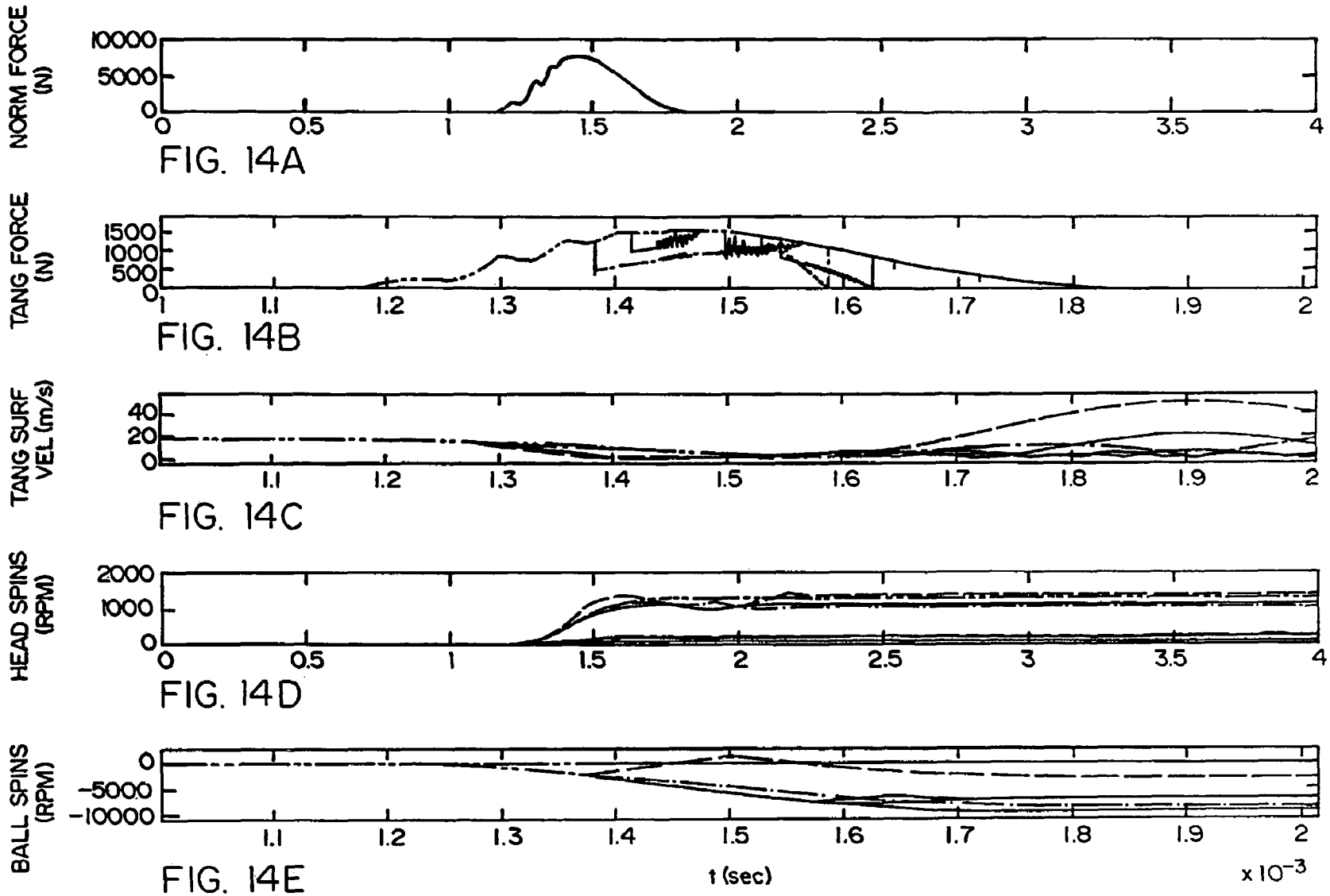
FIG. 14 (comprising 14A, 14B, 14C, 14D and 14E) is a graphical presentation of the time histories of key parameters in the ball to club impact with varying flexure angle derived from the simulation showing A) impact normal force, B) impact tangential (friction) force, C) relative tangential velocity time histories, D) head spin time histories, and E) resulting ball spin time histories.
Figures 15A, 15B, 15C, 15D, 15E:
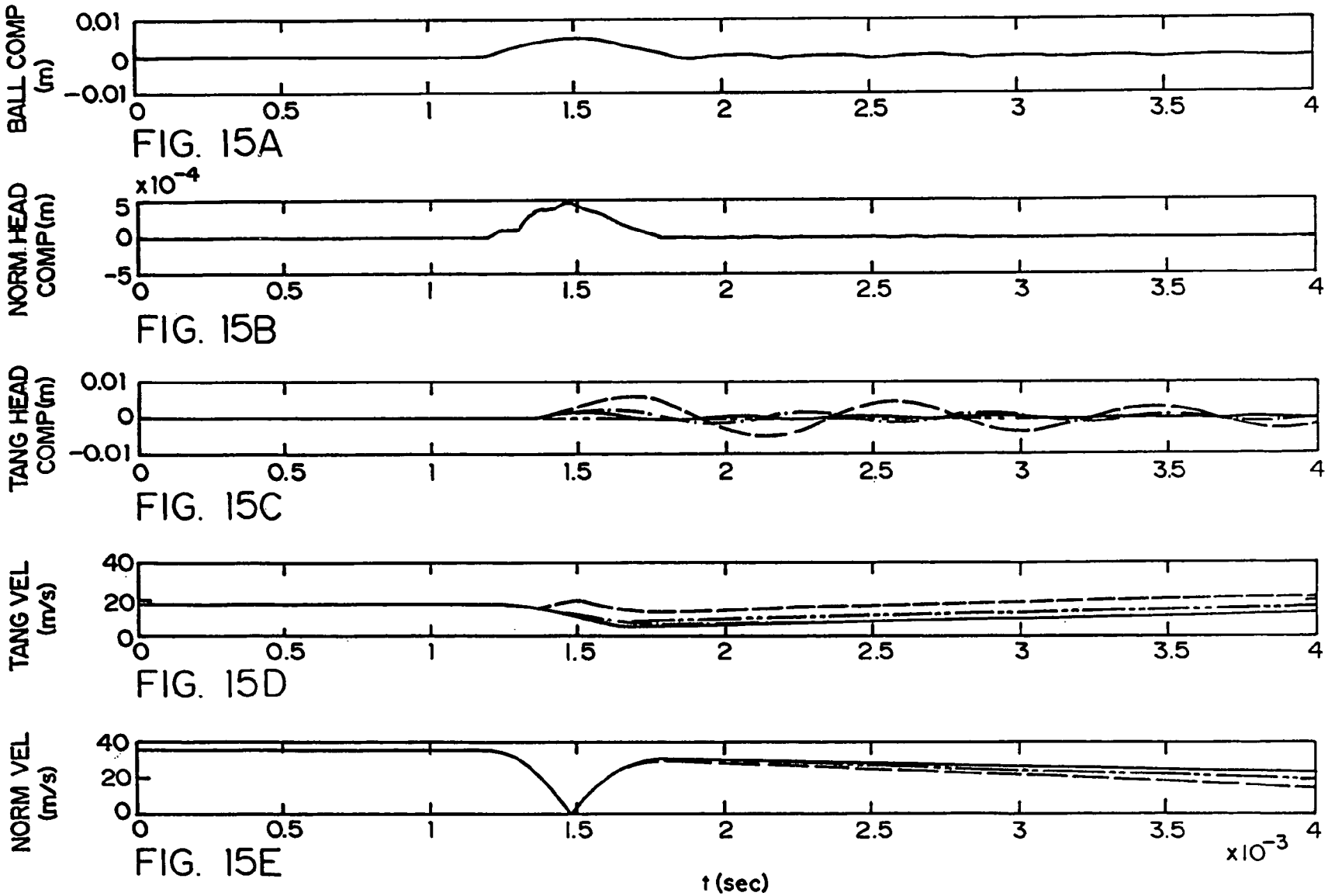
FIG. 15 (comprising 15A, 15B, 15C, 15D and 15E) is a graphical presentation of the time histories of key parameters in the ball to club impact with varying flexure angle derived from the simulation showing A) ball elastic deflection, B) relative normal face deflection, C) relative tangential face deflection, D) tangential ball CG velocity time histories, and E) normal ball velocity time histories.

FIGS. 12 and 13 present the time histories of the impact simulations for 3 cases described below. For reference in the curves in the figures, dash/dot=1 dashed=2, and solid=3.

| | Case Numbers: | | |
|---|---|---|---|
| | 1 dash/dot | 2 dashed | 3 solid |
| HeadVelocity(mph): | 89.48 | 89.48 | 89.48 |
| BallVelocity(mph): | 130.028 | 127.086 | 125.398 |
| BallLaunchAngle (elev.)(deg): | 17.1585 | 22.7782 | 18.7527 |
| BallLaunchAngle (yaw)(deg): | 0.0376313 | 0.159735 | 0.0747685 |
| BallSpin(top)(rpm): | 8327.01 | 3198.94 | 6410.85 |
| BallSpin(side)(rpm): | 44.6463 | 125.551 | 68.7056 |

Figures 16A, 16B, 16C, 16D, 16E:
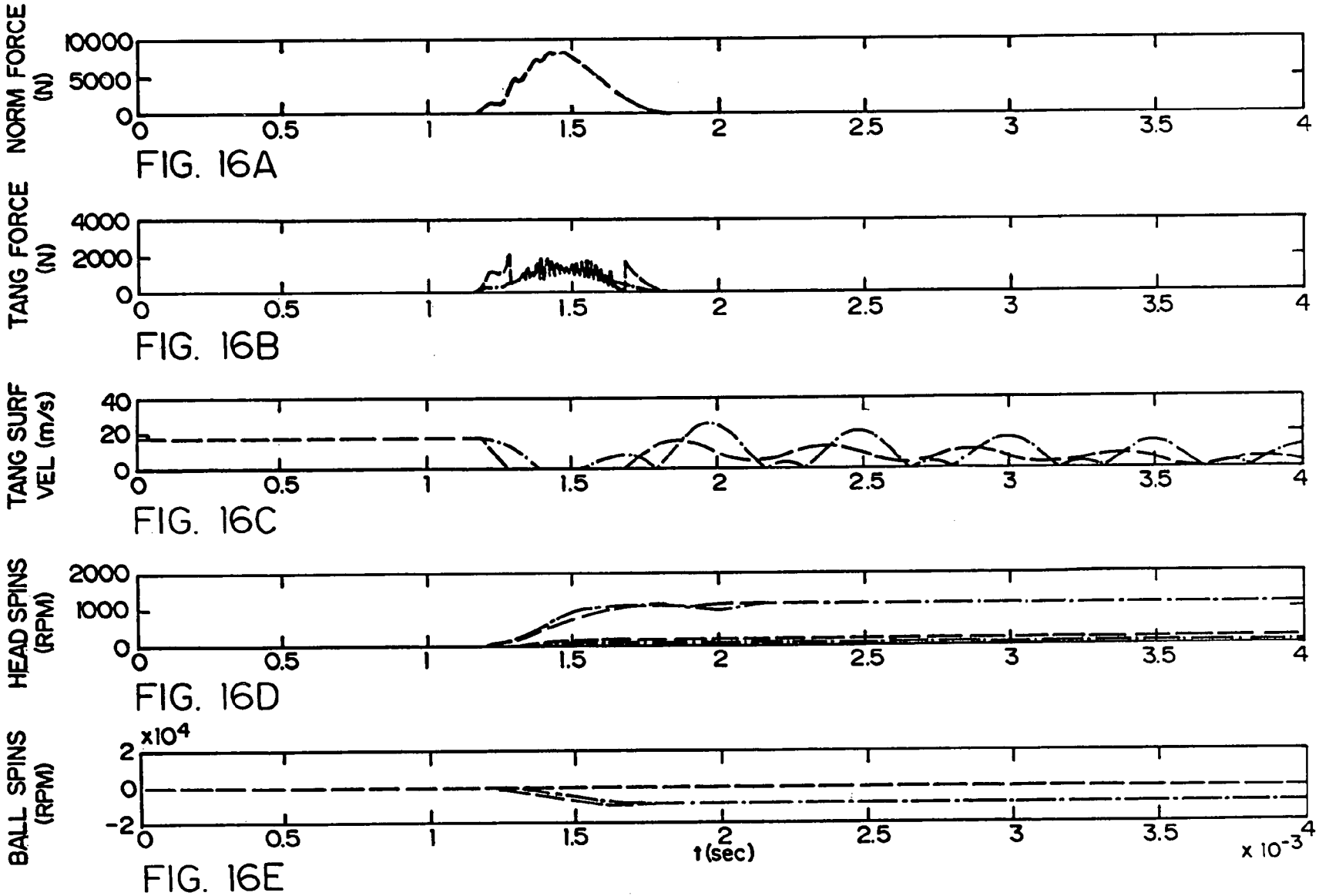
FIG. 16 (comprising 16A, 16B, 16C, 16D and 16E) is a graphical presentation of the time histories of key parameters in the ball to club impact with varying tangential stiffness (uncoupled) derived from the simulation showing A) impact normal force, B) impact tangential (friction) force, C) relative tangential velocity time histories, D) head spin time histories, and E) resulting ball spin time histories.
Figures 17A, 17B, 17C, 17D, 17E:
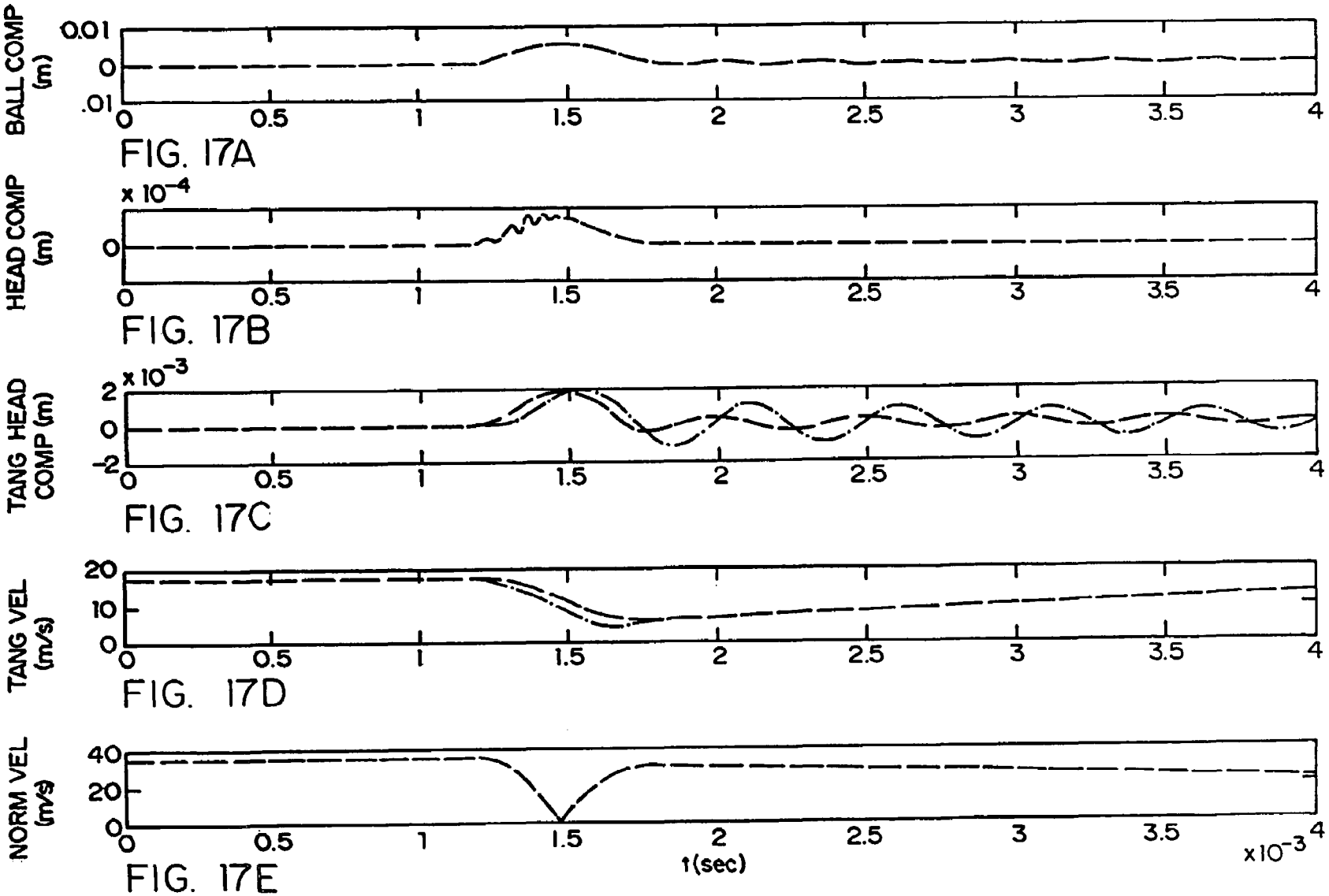
FIG. 17 (comprising 17A, 17B, 17C, 17D and 17E) is a graphical presentation of the time histories of key parameters in the ball to club impact with varying tangential stiffness (uncoupled) derived from the simulation showing A) ball elastic deflection, B) relative normal face deflection, C) relative tangential face deflection, D) tangential ball CG velocity time histories, and E) normal ball velocity time histories.

Tangential Stiffness (FIGS. 16 and 17)

A series of cases exploring the tangential stiffness tuning in the uncoupled cases. The baseline case is:

Case 1=Knn=1.8e7, Ktt=7.2e5, Knt=0 (dash/dot)

The stiffness variations are represented by:

Case2=Ktt/2 (dashed)

Case3=Ktt*2 (solid)

Case4=Ktt*8 (dash/double dot)

Case5=Ktt*32 (baseline "rigid tangential stiffness case")

| | Case Numbers: | | | | |
|---|---|---|---|---|---|
| | 1 | 2 | 3 | 4 | 5 |
| Head Velocity (mph): | 89.48 | 89.48 | 89.48 | 89.48 | 89.48 |
| Ball Velocity (mph): | 126.782 | 124.954 | 127.497 | 126.586 | 126.494 |
| Ball Launch Angle (elev.)(deg): | 16.7354 | 23.1676 | 15.7433 | 18.4742 | 18.5917 |
| Ball Launch Angle (yaw)(deg): | 0.064 | 0.2062 | 0.03187 | 0.07313 | 0.07265 |
| Ball Spin (top)(rpm): | 8406.61 | 2845.11 | 9206.93 | 6691.47 | 6658.87 |
| Ball Spin (side)(rpm): | 62.7807 | 151.819 | 41.5697 | 72.12 | 69.7804 |

Dash/dot represents a coupled face—with stiffness matrix Knn=4.4e6, Ktt=2.8e5, Knt=5.5e5. It represents a system with coupling between the normal and tangential directions. Dashed results from a system with no coupling but lower transverse stiffness. Knn=1.8e7, Knt=0, Ktt=7.2e5. This system corresponds to an elastic mount arrangement of 6 vertical posts approximately 0.5×1 mm in area and 5 mm long supporting a 10 gram face.

Solid represents a "rigid" face—very high normal and transverse stiffness. This verifies that the impact parameters such as spin approach the nominal case for a 5 iron. The nominal expected spin is therefore ~6400 RPM.

The increased spin Case 1 (dash/dot) and the decreased spin in Case 2 (dashed) arise from the movement of the face from its un-deformed position relative to the body of the club under the impact loading. The timing and direction of the movement is important and lead to the exploration and tailoring of the mount elasticity in support of a desired effect such as decreasing or increasing the spin. The timing of the face motion relative to the impact duration and event is especially critical in determining spin. The face mass in this series of cases is 10 grams.

A significant increase or decrease in spin can be achieved with the appropriate face coupling. These results are very sensitive to actual face tuning versus the impact duration It is evident that there is a tangential stiffness tuning which maximizes the effects leading to increased ball spin. The logic and analysis of the impact time histories is described below.

If the tangential stiffness is too low (case 2), then the face moves upward rapidly responding to the friction between the ball and the face. Since the stiffness is low (and the face is light—10 g) the face speeds up rapidly and exceeds the speed at which the ball CG is translating across the face—resulting in reduction of the ball spin. When the tangential stiffness finally causes the face to spring back, it spins the ball up again but its too little too late by then since the impact event is almost over (low stiffness means low face response frequency for a give face mass). This effect can be used to decrease the spin.

If the tangential stiffness is about right (cases 1, 3 illustrate the range of acceptable values), then the face moves up the club at a velocity a little slower the speed that the ball contact point is sliding/rolling up the face—so the ball continues to spin up while the face is also moving up the clubhead. The tangential stiffness and face mass is such that the face springs back while the ball impact is still ongoing (still have reasonable normal and tangential forces) so that the face springback increases the relative tangential velocity between the ball and the club face and continues to spin up the ball well beyond the normal amount (~+3000 RPM!). This can be used to increase the ball spin over what would occur with a conventional untailored face mounting.

If the tangential stiffness is too high (case 4,5), the face tangential motion doesn't matter or is insignificant. In this case, the ball spins up until the ball rolling matches the tangential velocity component between the ball and the face and the ball is essentially rolling up the face with no sliding at the face/ball interface. This is the same spin rate that is typically calculated in the simpler models. The system spin resultants approach this "rolling" spin value as the face tangential stiffness gets higher and higher.

The optimal stiffness range depends to first order on 1) ball-face friction coefficient, and 2) face loft and 3) face free mass. These all affect the face response timing to the tangential loading as well as the degree of that tangential loading.

These stiffnesses can be achieved by very conventional (uncoupled) flexure arrangements. This would consist of a series of elongated circular or rectangular posts supporting the face. It could also be string steel inserts at a number of locations. The baseline cases consist of 6, 1 mm square supports ~5 mm long.

The tangential deflections are not too large (approximately 3 mm for the baseline and 2 mm for case 3) which is good for design but the mount strains are still very large for these modules and it is desirable to select materials with high strain capability. Besides the normal titanium or steel alloys, other potential materials could be shape memory or pseudo-elastic materials (like Nitinol) for the modules or entire face assembly.

In the next few paragraphs a series of cases exploring the effects of loft angle and face mass will be described.

a key parameter (relative face/ball tangential velocities) that should be maintained in designs for differing face angles but similar desired ball spin effects.

Mass Variations (FIGS. 20 and 21)

In this section, a series of trials examining the effect of mass increase of the face will be explored. The cases are as follows:

Case 1 (solid): nominal 5 iron (27deg)—face at 10 grams similar to all previous analyses), stiffness —nominal, COF 0.2

Case 2 (dashed): loft —nominal, face at 20 g, stiffness —nominal, COF 0.2

Case 3 (solid): loft—nominal, face at 20 g, stiffness—x3, COF 0.2

Case 4 (dash/double dot): loft—nominal, face at 20 g, stiffness—x3, COF 0.5

Case 5: loft—nominal, face at 20 g, stiffness—nominal, COF 0.5

Results and explanations below:

| | Case Numbers: | | | | |
|---|---|---|---|---|---|
| | 1 | 2 | 3 | 4 | 5 |
| HeadVelocity(mph): | 89.48 | 89.48 | 89.48 | 89.48 | 89.48 |
| BallVelocity(mph): | 126.374 | 125.401 | 126.093 | 125.79 | 125.833 |
| BallLaunchAngle(elev.)(deg): | 15.904 | 17.3999 | 16.6756 | 18.8698 | 16.5546 |
| BallLaunchAngle(yaw)(deg): | 0.0471286 | 0.0803896 | 0.0423863 | 0.0485769 | 0.0437321 |
| BallSpin(top)(rpm): | 9040.29 | 7718.06 | 8193.13 | 6374.33 | 8772.42 |
| BallSpin(side)(rpm): | 49.4707 | 66.775 | 46.2163 | 58.7473 | 45.2584 |

Friction Coefficient and Loft Angle

Figures 18A, 18B, 18C, 18D, 18E:
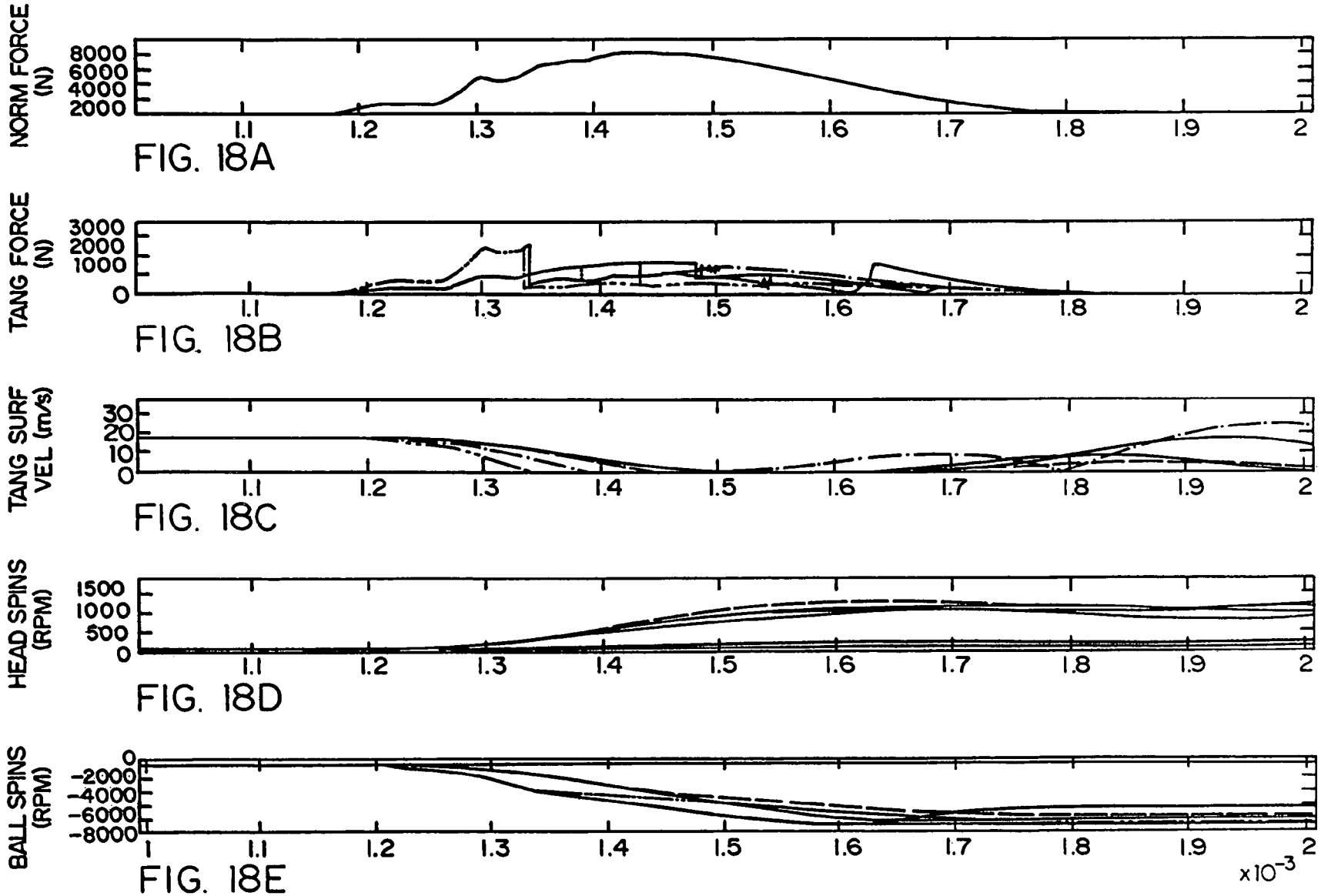
FIG. 18 (comprising 18A, 18B, 18C, 18D and 18E) is a graphical presentation of the time histories of key parameters in the ball to club impact with varying face friction coefficient derived from the simulation showing A) impact normal force, B) impact tangential (friction) force, C) relative tangential velocity time histories, D) head spin time histories, and E) resulting ball spin time histories.
Figures 19A, 19B, 19C, 19D, 19E:
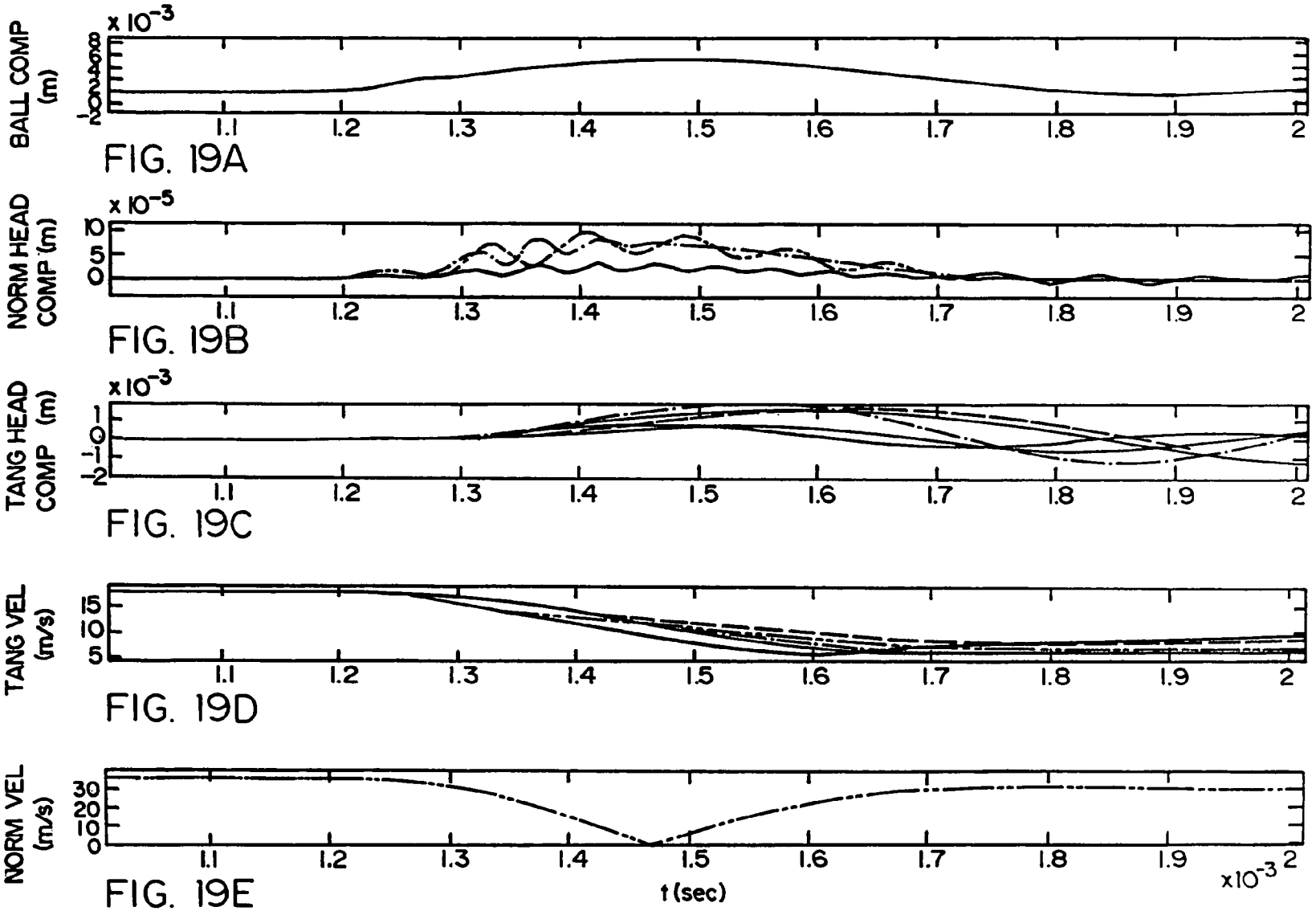
FIG. 19 (comprising 19A, 19B, 19C, 19D and 19E) is a graphical presentation of the time histories of key parameters in the ball to club impact with varying face friction coefficient derived from the simulation showing A) ball elastic deflection, B) relative normal face deflection, C) relative tangential face deflection, D) tangential ball CG velocity time histories, and E) normal ball velocity time histories.

FIGS. 18 and 19 show the effect of changing just COF on a 5 iron (27 degree loft) all else being the same in the two cases shown. The friction coefficient doesn't have a dramatic influence on the ball spin in this case. For a given loft angle the spin is relatively insensitive to friction coefficient. Dash/dot is 0.2 and dashed is 0.8—very different impacts but the result is similar.

If the face angle is changed from 27 degrees (5 iron) to 47 degree loft (modeling a wedge) and if the COF is increased from 0.2 to 0.5, then the behavior present with the lower loft irons/clubheads can be recovered even using the same stiffness. This is a COF readily achievable with a sand blasted surface. The reason is at higher loft angles there is lower face normal force and higher tangential velocity. The higher COF results in higher tangential face forces and results in higher face velocities/at the same approximate ratios of face tangential velocities/ball tangential velocities as is found in the lower loft angle clubheads with lower COFS. This describes An interpretation of the results follows:

The nominal cases have been run with the mass at 7 grams.

Figures 21A, 21B, 21C, 21D, 21E:
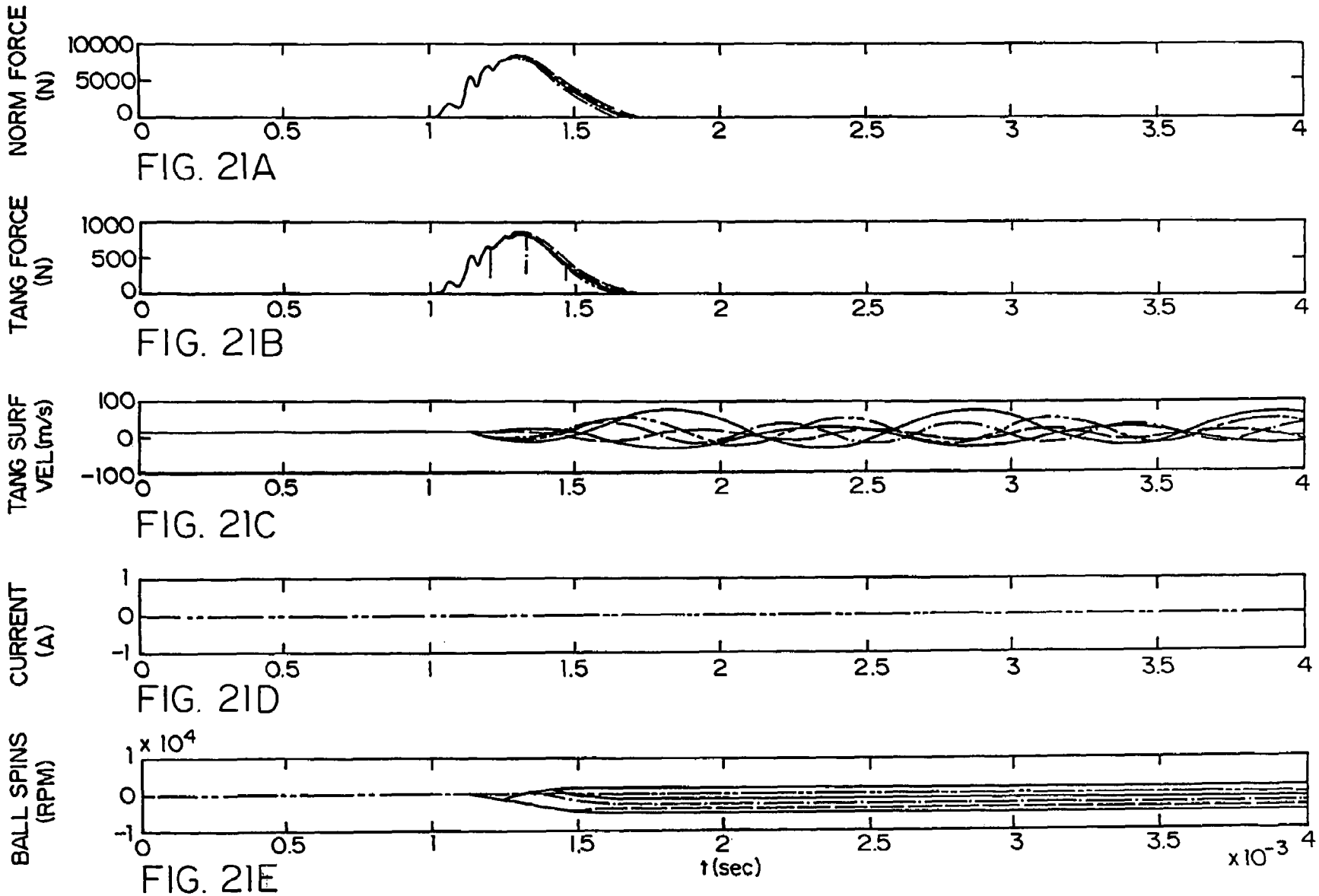
FIG. 21 (comprising 21A, 21B, 21C, 21D and 21E) is a graphical presentation of the time histories of key parameters in the ball to club impact with varying face mass derived from the simulation showing A) ball elastic deflection, B) relative normal face deflection, C) relative tangential face deflection, D) tangential ball CG velocity time histories, and E) normal ball velocity time histories.

Dash/dot is nominal with a base stiffness of Knn—1.08 e8 and Ktt=1.08e6 Knt=0 (uncoupled), this is accomplished with 24 1.5 cm long steel flexures of square cross section at 1.5 mm thickness. The most important plot to look at is the Tang surf velocity plot in FIG. 21C. When the tangential surface velocity goes to zero it implies that the relative velocity between the face and the ball surface has gone to zero, i.e., the ball is rolling and the face is moving such that the contact point is not slipping. FIG. 21C "Tang Head comp" the face moves upward in the first half of the impact then downward starting at 1.55 sec. The face velocity is the derivative of this curve and is much more important than head position in determining the spin. As the face reaches its most upward point and starts to move downward, its negative velocity increases and it starts to try to spin up the ball—this is evidenced by the rise in the "Tang Surf Vel" curve in FIG. 21C between 1.5 and 1.8 sec (dash/dot line). This spring back keeps the ball spinning up and is the source of the increased spin.

In general this leads to some tuning trends—first you want the tangential DOF to be roughly tuned to the impact timescale so that the face can spring back in the second half of the impact event. The cusp in the dash/dot curve on the "Tang SurfVel" graph in FIG. 21C at ~1.8 sec is the effect of the face slowing down as it comes to the furthest downward extent of its springback. It is important that this "end of springback" face slowing occurs at the tail end of the impact—otherwise it slows the ball spin before the ball leaves the face (as in the dash/double dot line in "Ball Spin" in FIG. 21E).

The dashed curves (case 2) represent the effect of increasing the face mass to 20 g all else the same. From the "tang Surf Vel" plot in FIG. 21C it seems that the large face inertia slowed down the face, making it take longer to speed up to match the ball—it only starts rolling at 1.45 s. More significantly for spin, it appears that the heavier mass slows spin up after the roll point is reached. This is because it is moving more slowly—it has a longer time constant and the velocities are correspondingly slower. The ball spin up that occurs while it is rolling on the face is associated with the face acceleration. Since the accelerations are not as high with the larger mass (and same stiffness) the spin up is noticeably less pronounced. The long time constant does help in that the spring back occurs late in the impact and therefore there is plenty of time for the system to spin up.

In an attempt to speed the system up, the stiffnesses (both normal and tangential) were increased by a factor of 3 (solid curve). This had only a small effect but it did speed the system up to the point that the end of the spring-back occurred right before the end of the impact. This allowed the oscillating face to de-spin the ball slightly before it left the face contact. All three of these cases had good spin—testifying to the robustness of the design.

Case 4 (dash/double dot) took the last case and raised the COF to 0.5 (the expected value) this had the effect of causing the ball to roll much more rapidly. The rolling condition is associated with lower friction forces so the face is accelerated less dramatically up, leading to a more rapid spring back relative to impact timing. The more rapid spring back runs its course and starts decelerating before the end of the impact. Since the friction is high this leads to the dramatic de-spin that occurs in the "Ball Spin" plot in FIG. 21E (dash/double dot).

Case 5 attempts to fix this by returning to the original stiffness, 20 g face, COF=0.5. The idea was to lower the stiffness so that the face would spring back more slowly and travel further. This worked—the inertia imparted by the high friction keeps the face moving upward and since it is a slower system, it returns after the impact is essentially over resulting in little to no de-spin.

It appears that the baseline stiffness is an accurate value for even a larger 20 g face. It is also significant that the COR of the face didn't change even as the mass increased. Typically a greater face mass would act as a drain for the ball kinetic energy.

Having thus disclosed various embodiments of the invention, it will now be apparent that many additional variations are possible and that those described therein are only illustrative of the inventive concepts. Accordingly, the scope hereof is not to be limited by the above disclosure but only by the claims appended hereto and their equivalents.

We claim:

1. A golf club iron head having a ball hitting face and a body defined by a top, a sole, a toe, a heel and a rear surface; the head comprising a metal face being elastically supported relative to said body for tangential motion in a selected direction relative to a plane parallel to said ball hitting face in response to impact of said head with a golf ball;

wherein said face is supported by a plurality of elastic mounts.

2. A golf club iron head having a ball hitting face and a body defined by a top, a sole, a toe, a heel and a rear surface; the head comprising a metal face being elastically supported relative to said body for tangential motion in a selected direction relative to a plane parallel to said ball hitting face in response to impact of said head with a golf ball;

wherein said face is supported by at least one elastic motion mount on an elongated beam.

3. The golf club head recited in claim 2 wherein said beam has a varying thickness along its length.

4. The golf club head recited in claim 3 wherein said beam is thinner at its center than at its ends.

5. A golf club iron head having a ball hitting face and a body defined by a top, a sole, a toe, a heel and a rear surface; the head comprising a metal face being elastically supported relative to said body for tangential motion in a selected direction relative to a plane parallel to said ball hitting face in response to impact of said head with a golf ball;

wherein said face is supported on a plurality of elastic mounts supported on a folded beam extending to said rear surface of said body.

* * * * *